US007448745B2

(12) United States Patent
Kibayashi

(10) Patent No.: US 7,448,745 B2
(45) Date of Patent: Nov. 11, 2008

(54) LIQUID DROPLET EJECTING DEVICE

(75) Inventor: Susumu Kibayashi, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 387 days.

(21) Appl. No.: 11/227,314

(22) Filed: Sep. 15, 2005

(65) Prior Publication Data

US 2006/0215008 A1 Sep. 28, 2006

(30) Foreign Application Priority Data

Mar. 24, 2005 (JP) ..... 2005-087311

(51) Int. Cl.
*B41J 2/01* (2006.01)

(52) U.S. Cl. ..... 347/104; 347/16; 400/629

(58) Field of Classification Search ..... 347/104; 400/629; 198/806, 807, 810.3
See application file for complete search history.

(56) References Cited

U.S. PATENT DOCUMENTS 5,078,263 A * 1/1992 Thompson et al. ..... 198/807
5,717,446 A * 2/1998 Teumer et al. ..... 347/35
5,717,984 A * 2/1998 Wong ..... 399/165
6,195,112 B1 * 2/2001 Fassler et al. ..... 347/219
6,298,586 B1 * 10/2001 Todome ..... 399/303
6,714,748 B1 * 3/2004 Nakayasu et al. ..... 399/72
2003/0076405 A1 * 4/2003 Sanchez et al. ..... 347/262
2004/0017456 A1 * 1/2004 Obertegger et al. ..... 347/104
2005/0088505 A1 * 4/2005 Shinohara ..... 347/116
2006/0050099 A1 * 3/2006 Murakami et al. ..... 347/19

FOREIGN PATENT DOCUMENTS

JP 2003-145777 5/2003
JP 2003-170645 6/2003

* cited by examiner

*Primary Examiner*—Matthew Luu
*Assistant Examiner*—Joshua M Dubnow
(74) *Attorney, Agent, or Firm*—Fildes & Outland, P.C.

(57) ABSTRACT

The present invention provides a liquid droplet ejecting device, which can form a good eject pattern even when a recording medium is conveyed by a conveying belt at a side-to-be-ejected by a liquid droplet ejecting head in which ejecting nozzles are arranged two-dimensionally, including a liquid droplet ejecting head at which an arrangement of ejecting nozzles which eject liquid droplets is formed in two-dimensions; and a conveying section which conveys a recording medium at a side-to-be-ejected by the liquid droplet ejecting head, wherein the conveying section has an endless conveying belt on which the recording medium is placed and which passes by the side to be ejected by the liquid droplet ejecting head, at least two rollers which abut the conveying belt and whose positions can be corrected; and a control section which controls position corrections of the at least two rollers.

19 Claims, 26 Drawing Sheets

LIQUID DROPLET EJECTING DEVICE

CROSS-REFERENCE TO RELATED APPLICATION

This application claims priority under 35 USC 119 from Japanese Patent Application No. 2005-087311, the disclosure of which is incorporated by reference herein.

BACKGROUND OF THE INVENTION

1. Field of the Invention

The present invention relates to a liquid droplet ejecting device which ejects liquid droplets, and in particular, to a liquid droplet ejecting device which is optimal for forming images by ejecting ink droplets at an FWA-type inkjet recording head.

2. Description of the Related Art

The development of inkjet recording devices, which use an FWA (Full Width Array) type inkjet recording head (an FWA head) equipped with ejecting nozzles which are lined-up in an axial direction orthogonal to the conveying direction of the recording medium, has evolved more and more in recent years in order to record at high speeds. In such an inkjet recording device, forming the arrangement of the ejecting nozzles two-dimensionally is effective in order to obtain a high resolution.

In such an FWA head which is formed two-dimensionally, there are many cases in which there are portions (discontinuous portions) where the distance, in a sheet conveying direction, between ejecting nozzles which are adjacent to one another in the axial direction, is large (see, for example, Japanese Patent Application Laid-Open (JP-A) Nos. 2003-145777 and 2003-170645).

Further, the sheet must be conveyed at a right angle with respect to the FWA head. If the sheet is not conveyed at a right angle, on the sheet, the aforementioned interval in the axial direction of the discontinuous portion differs from other portions, and when the interval widens, a white stripe forms, and when the interval narrows, a black stripe forms, and the image quality deteriorates. Therefore, the FWA head and the sheet conveying unit must be positioned with accurate perpendicularity therebetween. However, what is important is the perpendicularity between the FWA head and the sheet conveying direction (belt conveying direction). If this perpendicularity is not met, it will be insufficient even if the perpendicularity of the FWA head with respect to the sheet conveying unit is achieved. Detailed explanation will be given hereinafter by using examples and by referring to the drawings.

As shown in FIGS. 30A, 30B, 31A, 31B, 32A, and 32B, an inkjet recording head 103 is an FWA-type inkjet recording head which is elongated and at which the arrangement of ejecting nozzles 98 is formed two-dimensionally.

The ejecting nozzles 98 form plural ejecting nozzle rows 99. The ejecting nozzle rows 99 are lined-up along a direction V so as to be parallel to one another.

In intervals between adjacent ejecting nozzles 98, components thereof in an X direction, which is orthogonal to a conveying direction Y of a sheet P, are uniform. As shown in FIGS. 30A and 30B, when the inkjet recording head 103 is orthogonal to the conveying direction Y of the sheet P (i.e., when the longitudinal direction of the inkjet recording head 103 is parallel to the X direction), the aforementioned component in the X direction (the X direction nozzle pitch) is ΔX.

In intervals between adjacent ejecting nozzles 98, components thereof in the Y direction, which is parallel to the conveying direction Y of the sheet P, are uniform in the same ejecting nozzle row, but are greater in the Y direction in each of adjacent ejecting nozzle rows. As shown in FIGS. 30A and 30B, when the inkjet recording head 103 is orthogonal to Y direction, the aforementioned component in the Y direction (the Y direction nozzle pitch) is AY, and the aforementioned component in the Y direction in each of the adjacent ejecting nozzle rows is greater, that is, a distance LY.

As shown in FIGS. 31A and 31B, in a case in which the inkjet recording head 103 is, as compared with the state shown in FIGS. 30A and 30B, tilted by being rotated left in the drawing (paper) by angle θ and the X direction width of the ejecting nozzle row 99 narrows and becomes W-ΔW, the X direction width of adjacent ejecting nozzles 98 is ΔX-e1 in the same ejecting nozzle row, and is ΔX+e2 at the adjacent ejecting nozzle rows.

As shown in FIGS. 32A and 32B, in a case in which the inkjet recording head 103 is, as compared with the state shown in FIGS. 30A and 30B, tilted by being rotated right in the drawing by angle θ and the X direction width of the ejecting nozzle row 99 widens and becomes W+ΔW, the X direction width of adjacent ejecting nozzles 98 is ΔX+e1 in the same ejecting nozzle row, and is ΔX-e2 at the adjacent ejecting nozzle rows.

Given that the width of the inkjet recording head 103 in the Y direction (the sheet conveying direction) is B, the following formulas are established.

$$e1=\Delta X(1-\cos\theta)-\Delta Y\sin\theta$$

$$e2=\Delta X(\cos\theta-1)-B\sin\theta$$

$$\text{pitch error}=e1+e2=(B-\Delta Y)\sin\theta$$

Here, given that B=30 mm and ΔY=0.5 mm, the pitch error (e1+e2) of ΔX, at θ=0.00033 rad (0.1 mm/300 mm), is 10 μm.

When the pitch error becomes as large as about 10 μm, white stripes 104 (see FIGS. 31A and 31B) or black stripes 106 (see FIGS. 32A and 32B) are conspicuous and problematic.

In particular, in a device which obtains full-color images, because the FWA head is structured by plural ejecting nozzles being lined-up, a unit which holds a recording sheet to a conveying belt and conveys the recording sheet is used as the aforementioned sheet conveying unit. Generally, a conveying belt is provided with a walking preventing section so that the belt does not move in the direction orthogonal to the conveying direction. In the present specification, the belt moving in the direction orthogonal to the conveying direction is called walking. There is a method in which guide members are adhered to the end portions of the belt such that walking of the belt is prevented at the guide members (and also a method of directly guiding the belt end portions by the guide members), and a method in which walking of the belt is prevented by tilting a driven roller (a steering method). In the case of preventing walking by providing guide members, because the accuracy of the guide members affects the belt walking, usually, conveying can be carried out at a walking preventing accuracy of about 0.1 to 0.2 mm. On the other hand, in the steering method, the end portion of the belt is detected at a sensor, and the tilting of the roller can be controlled electrically. Therefore, fine control is possible, and walking can be controlled at an accuracy of less than or equal to 0.05 mm. In a device for full-color images, in order to prevent miss color registration (miss color registration must be kept to less than or equal to 0.1 mm), belt walking must be controlled highly accurately, and the steering method is effective. However, even when such a belt walking preventing section is provided and walking of the belt is prevented, the belt conveying direction is not perpendicular to the axis of the roller. Namely, there is a case in which the belt conveying direction is not perfectly perpendicular to the axis of the roller but is slightly different from a direction which is perpendicular to the axis of the roller. In the present specification, this is defined as belt skewing. The belt conveying direction is problematic not only in belt skewing (see FIG. 8), but also in cases in which the belt conveying device is at an angle with respect to the FWA head (see FIG. 10).

Accordingly, the belt conveying direction (angle) is important.

The belt conveying direction changes due to various causes such as the state of the conveying belt, the environment, the setting conditions, and the like. Therefore, there are cases in which the belt conveying direction changes at the time of assembly at the factory, at the time of set-up, at the time of start-up, at the time of continuous printing, and the like. Thus, it is important to always maintain the belt conveying direction at a predetermined direction (in many cases, orthogonal) with respect to the FWA head, and to prevent walking and skewing from arising at the conveying belt.

This is not limited to FWA-type inkjet recording heads, and the same holds for inkjet recording devices equipped with PWA-type inkjet recording heads. Moreover, this is not limited to inkjet recording devices, and the same holds when conveying an object-of-adhesion, to which ejected liquid droplets are to be adhered, by a conveying belt at a ejecting side of a liquid droplet ejecting head even in a liquid droplet ejecting device which has a liquid droplet ejecting head in which ejecting nozzles for liquid droplet ejecting are arranged two-dimensionally.

SUMMARY OF THE INVENTION

In view of the aforementioned, the present invention provides a liquid droplet ejecting device which can form a good eject pattern even when an object-of-adhesion, to which liquid droplets are to be adhered, is conveyed by a conveying belt at side to be ejected by a liquid droplet ejecting head in which ejecting nozzles are arranged two-dimensionally.

The present inventors investigate causes as to why it is difficult to always maintain a belt conveying direction at a predetermined direction with respect to an FWA head. They found that walking and skewing arise at a conveying belt, but that if one is controlled by using a single roller for adjustment which contacts the conveying belt, the other cannot be controlled. Factors generating walking and skewing are substantially the same, and are roller alignment, difference in belt circumferential lengths, the conicity of the rollers, and the like.

On the other hand, walking and skewing arise independently of one another, and frequently, both arise simultaneously. Usually, walking becomes a great problem, and a roller for adjustment is controlled so as to prevent walking. As a result, skewing of the conveying belt remains.

Thus, the present inventors diligently study controlling both walking and skewing, and accumulating these studies, complete the present invention.

An aspect of the present invention is a liquid droplet ejecting device including: a liquid droplet ejecting head at which an arrangement of ejecting nozzles which eject liquid droplets is formed in two-dimensions; and a conveying section which conveys a recording medium at a side to be ejected by the liquid droplet ejecting head (at a position which faces a liquid droplet ejecting surface of the head), wherein the conveying section has: an endless conveying belt on which the recording medium is placed and which passes by the side to be ejected by the liquid droplet ejecting head; at least two rollers which abut the conveying belt and whose positions can be corrected; and a control section which controls position corrections of the at least two rollers.

Another aspect of the present invention is a liquid droplet ejecting device including: a liquid droplet ejecting head at which an arrangement of ejecting nozzles which eject liquid droplets is formed in two-dimensions; a conveying section which conveys a recording medium at a side to be ejected by the liquid droplet ejecting head (at a position which faces a liquid droplet ejecting surface of the head), an endless conveying belt on which the recording medium is placed and which passes by the side to be ejected by the liquid droplet ejecting head; at least two rollers which abut the conveying belt and whose positions can be corrected; correcting sections which respectively perform position corrections of the at least two rollers; a control section which controls the position corrections by the correcting sections; a skewing detecting section which detects skewing of the conveying belt; and a walking detecting section which detects walking of the conveying belt, wherein, on the basis of a skew amount detected by the skewing detecting section and a walking amount detected by the walking detecting section, the control section controls the position corrections by the correcting sections.

The liquid droplet ejecting device is not limited to an inkjet recording head, and also includes devices which eject liquid droplets in order to form wiring patterns or the like.

The recording medium of course includes recording sheets, OHP sheets, and the like, and in addition thereto, also includes, for example, substrates and the like on which wiring patterns and the like are formed. Further, the ejected pattern formed on the recording medium by the ejecting of the liquid droplets includes not only general images (characters, drawings, photographs, and the like), but also the aforementioned wiring patterns, three-dimensional object, organic thin films, and the like. The liquid which is ejected also is not limited to colored inks.

In the aspect of the present invention, the positions of the two rollers can be corrected. Therefore, walking correction can be carried out at one roller, and skewing correction can be carried out at the other roller. Accordingly, even if a liquid droplet ejecting head such as described above is provided, it is possible to obtain a liquid droplet ejecting device in which walking and skewing are prevented from arising at the conveying belt.

In accordance with the present invention, there is provided a liquid droplet ejecting device which can form a good eject pattern even when an object-of-adhesion, to which liquid droplets are to be adhered, is conveyed by a conveying belt at a side to be ejected by a liquid droplet ejecting head in which ejecting nozzles are arranged two-dimensionally.

BRIEF DESCRIPTION OF THE DRAWINGS

Embodiments of the invention will be described in detail with reference to the following figures, wherein.

DETAILED DESCRIPTION OF THE INVENTION

Figure 1:
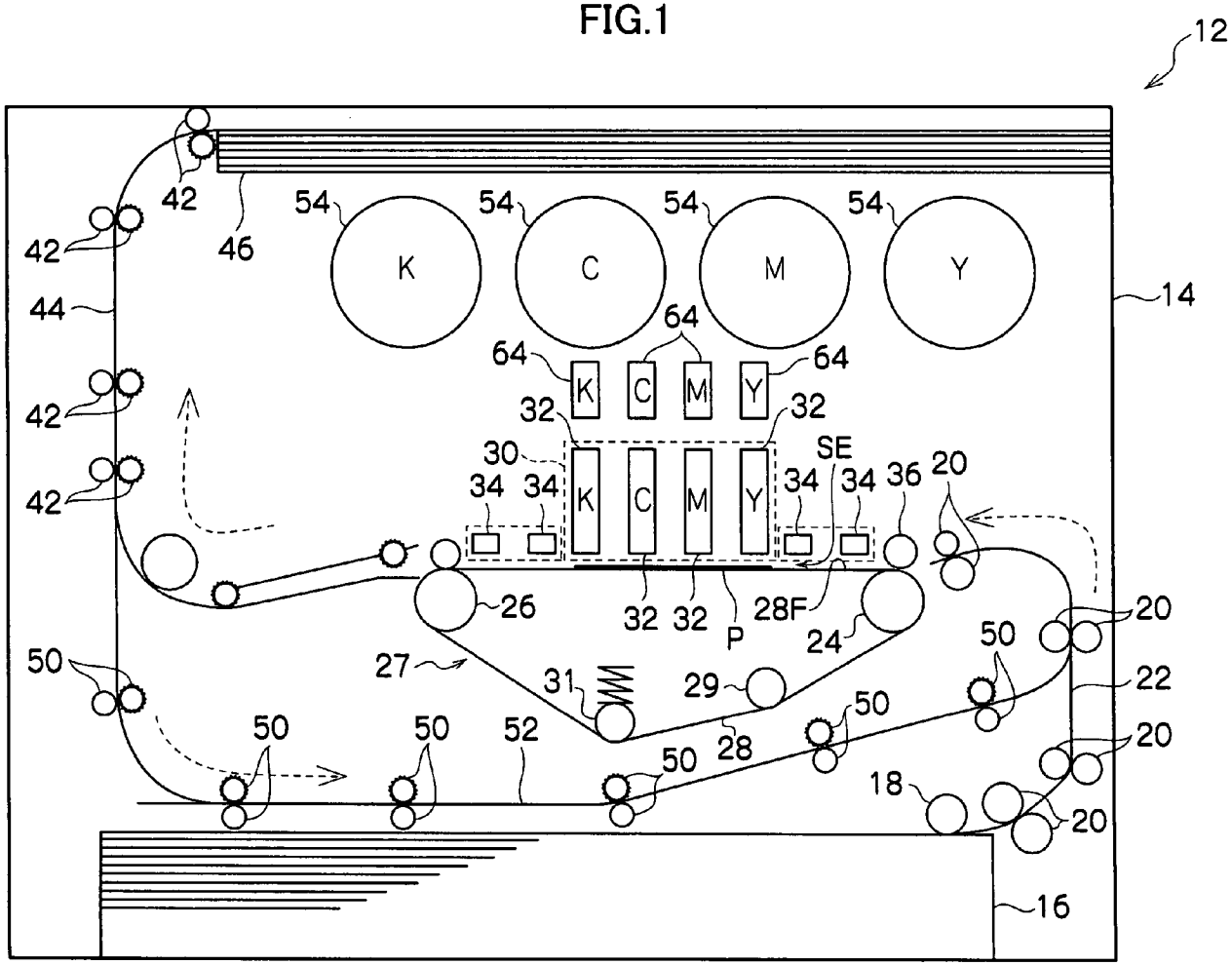
FIG. 1 is a front sectional view showing the structure of an inkjet recording device of a first embodiment, in an image recording state.

Embodiments of the present invention will be described hereinafter by using an inkjet recording device as an example. In the following embodiments, explanation will be given by using a recording sheet (hereinafter simply called "sheet") as an example of a recording medium, but the present invention can also be implemented with respect to recording media other than recording sheets. Note that, from a second embodiment on, structural elements which are similar to those described previously are denoted by the same reference numerals, and description thereof is omitted.

FIRST EMBODIMENT

First, a first embodiment will be described.

(Overall Structure)

Figure 2:
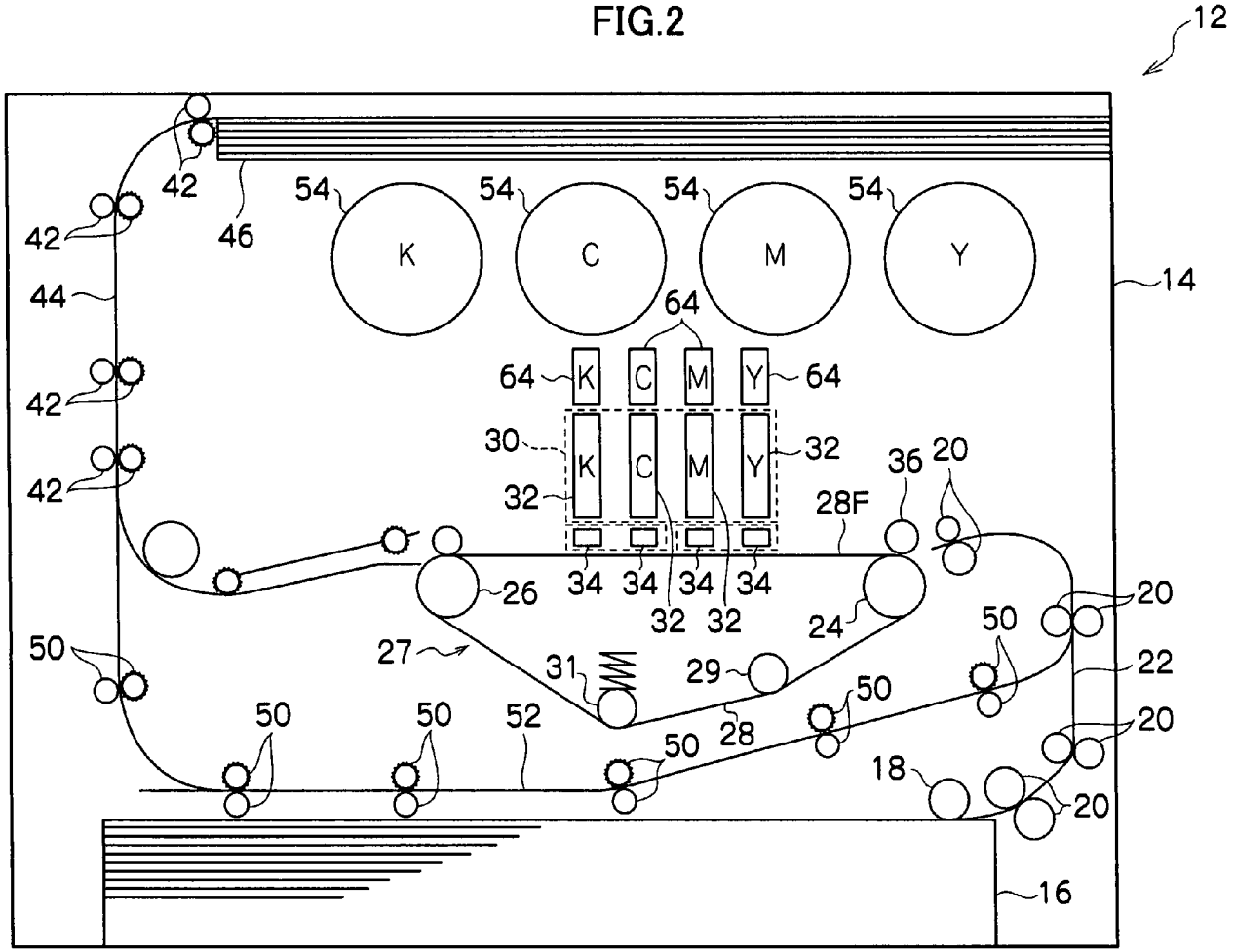
FIG. 2 is a front sectional view showing the structure of the inkjet recording device of the first embodiment, in a maintenance state.
Figure 3:
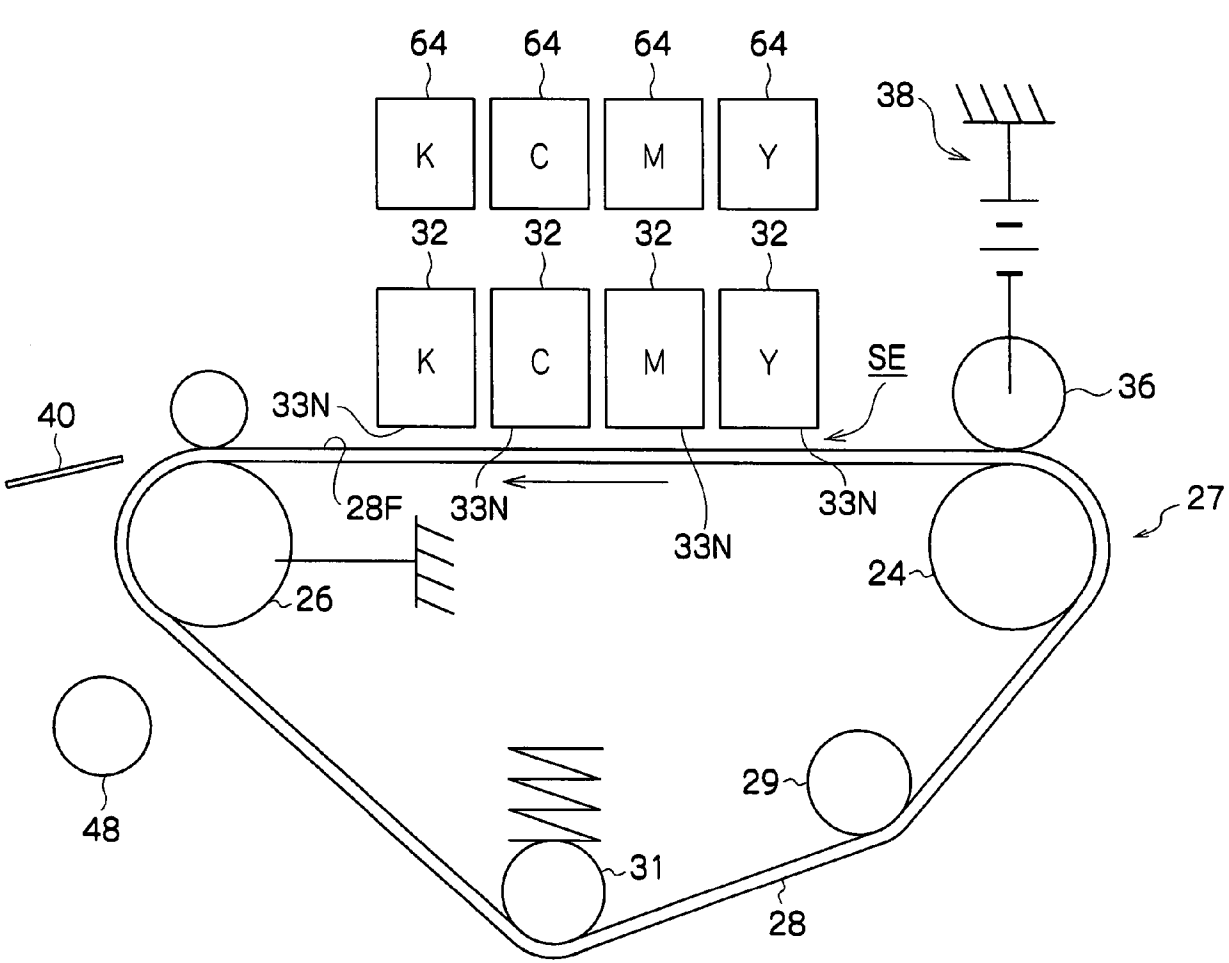
FIG. 3 is a schematic diagram showing the structure of a conveying belt, and the vicinity thereof, of the inkjet recording device of the first embodiment.

An inkjet recording device 12 of a first embodiment of the present invention is shown in FIGS. 1 through 3. A sheet feeding tray 16 is provided at the lower portion of the interior of a housing 14 of the inkjet recording device 12. Sheets P, which are stacked in the sheet feeding tray 16, can be taken-out one-by-one by a pick-up roller 18. The sheet P which is taken-out is conveyed by plural conveying roller pairs 20 which structure a predetermined conveying path 22. When the expression "the conveying direction" is used simply hereinafter, it refers to the conveying direction of the sheet P which is the recording medium.

A conveying unit 27 which conveys the sheet P is disposed above the sheet feeding tray 16. An endless conveying belt 28 which conveys the sheet P is provided at the conveying unit 27. As an example, a structure formed by forming (shaping) a semi-electrically-conductive polyimide material (surface electrical resistance: $10^{10}$ to $10^{13}$ Ω/□, volume resistivity: $10^{9}$ to $10^{12}$ Ω·cm) to a thickness of 75 μm, a width of 380 mm, and a peripheral length of 1000 mm, can be used as the conveying belt 28. Further, as an example, SUS rollers of ϕ 50 mm can be used as driving and driven rollers 24 and 26. A recording head array 30 is disposed above the conveying belt 28, and opposes a flat portion 28F of the conveying belt 28. This opposing region is ejecting region SE where ink droplets are ejected from the recording head array 30. The sheet P conveyed along the conveying path 22 is held at the conveying belt 28 and reaches the ejecting region SE, and in a state in which the sheet P opposes the recording head array 30, ink droplets corresponding to image information are adhered thereto from the recording head array 30.

Then, by circulating the sheet P (the conveying belt 28) in the state in which the sheet P is held on the conveying belt 28, the sheet P passes through the ejecting region SE plural times, and so-called multipass image recording can be carried out. Accordingly, the surface of the conveying belt 28 is the circulating path of the sheet P in the present invention.

In the present embodiment, the effective recording region of the recording head array 30 is elongated and is of a length which is greater than or equal to the width of the sheet P (the length in the direction orthogonal to the conveying direction). Four inkjet recording head units 32 (hereinafter simply called "head units 32"), which correspond respectively to the four colors of yellow (Y), magenta (M), cyan (C), and black (K), are disposed along the conveying direction, such that a full-color image can be recorded. Note that the method of ejecting the ink droplets in the respective head units 32 is not particularly limited, and a known system, such as so-called thermal system or piezoelectric system or the like, can be used.

An inkjet recording head 33, which structures each head unit 32, is an FWA-type inkjet recording head in which the arrangement of a large number of ejecting nozzles 78 (see FIG. 5) which eject ink droplets is formed in two dimensions. In the present embodiment, the ejecting nozzles 78 are arranged along the longitudinal direction of the inkjet recording head 33.

The inkjet recording device 12 is controlled by a head controller 60. For example, the head controller 60 determines, in accordance with image information, the ejecting timings of the ink droplets and the ink ejecting openings (nozzles) which are to be used, and sends driving signals to the inkjet recording heads 33.

The recording head array 30 may be made to be immobile in the direction orthogonal to the conveying direction. However, if the recording head array 30 is structured so as to move when needed, in multipass image recording, it is possible to record an image of a higher resolution, and it is possible to not reflect the problems of the inkjet recording heads 33 in the recorded results.

Four maintenance units 34, which correspond to the respective head units 32, are disposed in a vicinity of the recording head array 30 (in the present embodiment, at both sides in the conveying direction). When maintenance is to be carried out on the head units 32, as shown in FIG. 2, the recording head array 30 moves upward, and the maintenance units 34 move so as to enter into the space formed between the recording head array 30 and the conveying belt 28. The maintenance units 34 carry out predetermined maintenance operations (vacuuming, dummy jetting, wiping, capping, and the like) in a state of opposing nozzle surfaces 33N (see FIGS. 3 and 7) which are ejecting surfaces.

Note that, in the present embodiment, the four maintenance units 34 are divided into two groups of two, and are disposed at the conveying direction upstream side and the conveying direction downstream side of the recording head array 30 at the time of image recording.

As shown in detail in FIG. 3 as well, a charging roller 36, to which a power source 38 is connected, is disposed at the conveying direction upstream side of the recording head array 30. The charging roller 36 can be moved between a pressing position, at which the charging roller 36 is slave-driven while, together with the driving roller 24 which will be described later, nipping the conveying belt 28 and the sheet P therebetween and the charging roller 36 presses the sheet P to the conveying belt 28, and a separated position, at which the charging roller 36 is separated from the conveying belt 28. At the pressing position, a predetermined potential difference arises between the charging roller 36 and the driving roller 24 which is grounded, and therefore, charges are applied to the sheet P and the sheet P can be electrostatically attracted to the conveying belt 28.

For example, a roller of $\phi$ 14 mm, at which an electrically conductive carbon is covered on the surface of silicone rubber and whose volume resistivity is adjusted to about $10^6$ to $10^7$ $\Omega\cdot$cm, can be used as the charging roller 36.

In FIG. 3, a DC power source is shown as an example of the power source 38, but an AC power source may be used if the sheet P can be charged to a predetermined potential.

A register roller (not illustrated) is provided at the conveying direction upstream side of the charging roller 36, such that the sheet P can be registered before reaching between the conveying belt 28 and the charging roller 36.

A peeling plate 40 (see FIGS. 1 and 2) is disposed at the conveying direction downstream side of the recording head array 30, and can peel the sheet P off from the conveying belt 28.

For example, an aluminum plate of a thickness of 0.5 mm, a width of 330 mm, and a length of 100 mm can be used as the peeling plate 40.

The sheet P which is peeled off is conveyed by plural, rotatable discharging roller pairs 42 which structure a discharge path 44 at the conveying direction downstream side of the peeling plate 40, and is discharged onto a sheet discharge tray 46 provided at the upper portion of the housing 14.

A cleaning roller 48 which, together with the driven roller 26 which will be described later, can nip the conveying belt 28, is disposed beneath the peeling plate 40, and cleans the surface of the conveying belt 28.

An inverting path 52, which is structured by plural inverting roller pairs 50, is provided as an inverting section between the sheet feeding tray 16 and the conveying belt 28. Due to the inverting path 52 inverting the sheet P, on whose one side an image is recorded, and holding the sheet P at the conveying belt 28, image recording onto both sides of the sheet P can be carried out easily.

Ink tanks 54, which store inks of the four colors respectively, and reservoir tanks 64, which are connected to the downstream sides of the ink tanks 54, are provided between the conveying path 28 and the sheet discharge tray 46. A portion which is open to the atmosphere is provided at each of the reservoir tanks 64, and the liquid surfaces within the reservoir tanks 64 are atmospheric pressure. The inks in the reservoir tanks 64 are supplied to the corresponding head units 32. Any of various types of known inks, such as water-based inks, oil-based inks, solvent inks, or the like, can be used as the inks.

Figure 4:
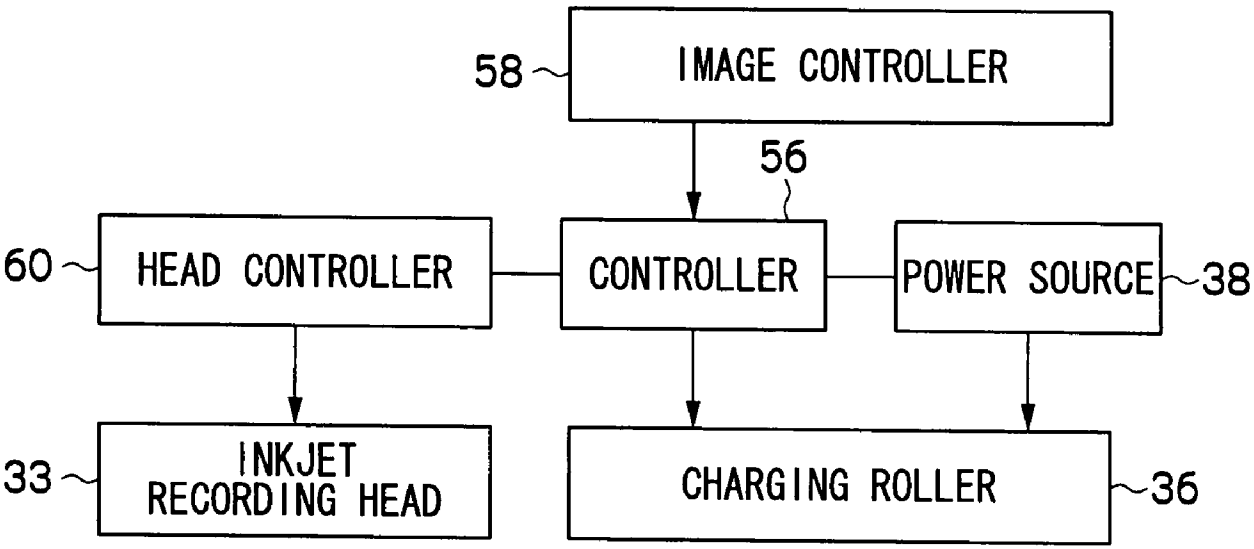
FIG. 4 is a block diagram showing the structure of a control system of the inkjet recording device of the first embodiment.

As shown in FIG. 4, the entire inkjet recording device 12 is controlled by a controller 56. Operations from the taking-out of the sheet P, to image recording, discharging, and even maintenance, are controlled. Various types of data and the like relating to the image to be recorded are sent from an image controller 58 to the controller 56. For example, as will be described later, the applied voltages in a first charging mode and a second charging mode, and the like, are controlled by the controller 56 in accordance with the data of the image to be recorded and the like. Further, the inkjet recording heads 33 are controlled by the head controller 60, and signals are transmitted from the controller 56 to the head controller 60. The controller 56, the head controller 60, and the charging roller 36 receive supply of electric power from the power source 38.

In the inkjet recording device 12 of the present embodiment which is structured overall in this way, as described above, the sheet P, which is taken-out from the sheet feeding tray 16, is conveyed and reaches the conveying belt 28. Then, the sheet P is pressed against the conveying belt 28 by the charging roller 36, and is attracted to (fit tightly to) and held at the conveying belt 28 due to the applied voltage from the charging roller 36. In this state, while the sheet P passes through the ejecting region SE due to the circulating of the conveying belt, ink droplets are ejected from the recording head array 30, and an image is recorded on the sheet P. In the case of single-pass image recording, the sheet P is peeled-off from the conveying belt 28 by the peeling plate 40, is conveyed by the discharging roller pairs 42, and is discharged onto the sheet discharge tray 46. In the case of multipass image recording, the sheet P is circulated and passed through the ejecting region SE until the requisite number of times is reached, and thereafter, the sheet P is peeled-off from the conveying belt 28 by the peeling plate 40, is conveyed by the discharging roller pairs 42, and is discharged onto the sheet discharge tray 46.

(Sheet Conveying Mechanism)

The conveying unit 27 has the driving roller 24 and the driven roller 26 which are provided at the both end sides in the conveying direction of the conveying belt 28, and the conveying belt 28 is stretched between the driving roller 24 and the driven roller 26. Further, the conveying unit 27 is provided with a skewing adjusting roller 29, which abuts the conveying belt 28 from the inner peripheral surface side thereof and adjusts the skewing of the conveying belt 28, and a tension roller 31 which abuts the conveying belt 28 from the inner peripheral surface side thereof and adjusts the tension of the conveying belt 28.

Note that, in the present specification, correcting the positions of the driven roller 26 and the skewing adjusting roller 29 is called "steering".

For example, the vertical position of one side portion in the rotational axis direction of the driven roller 26 can be adjusted (steering can be carried out), such that the driven roller 26 functions as a walking adjusting roller.

The steering of the driven roller 26 and the steering of the skewing adjusting roller 29 are both controlled by the controller 56. The form of the control is not particularly limited to automatic or manual or the like.

In the case of automatic control, the following is possible for example: the inkjet recording device 12 has a skewing detecting device, which detects skewing of the conveying belt 28, and a walking detecting device, which detects walking of the conveying belt 28, and the controller 56 carries out steering of the driven roller 26 and the skewing adjusting roller 29 on the basis of the skew amount detected at the skewing detecting device and the walking amount detected at the walking detecting device.

In the case of manual control, the following is possible for example: the inkjet recording device 12 has an inputting section at which data corresponding to the control of the controller 56 is inputted by an operator, and the controller 56 carries out steering of the driven roller 26 and the skewing adjusting roller 29 on the basis of the data inputted from the inputting section.

Figure 20:
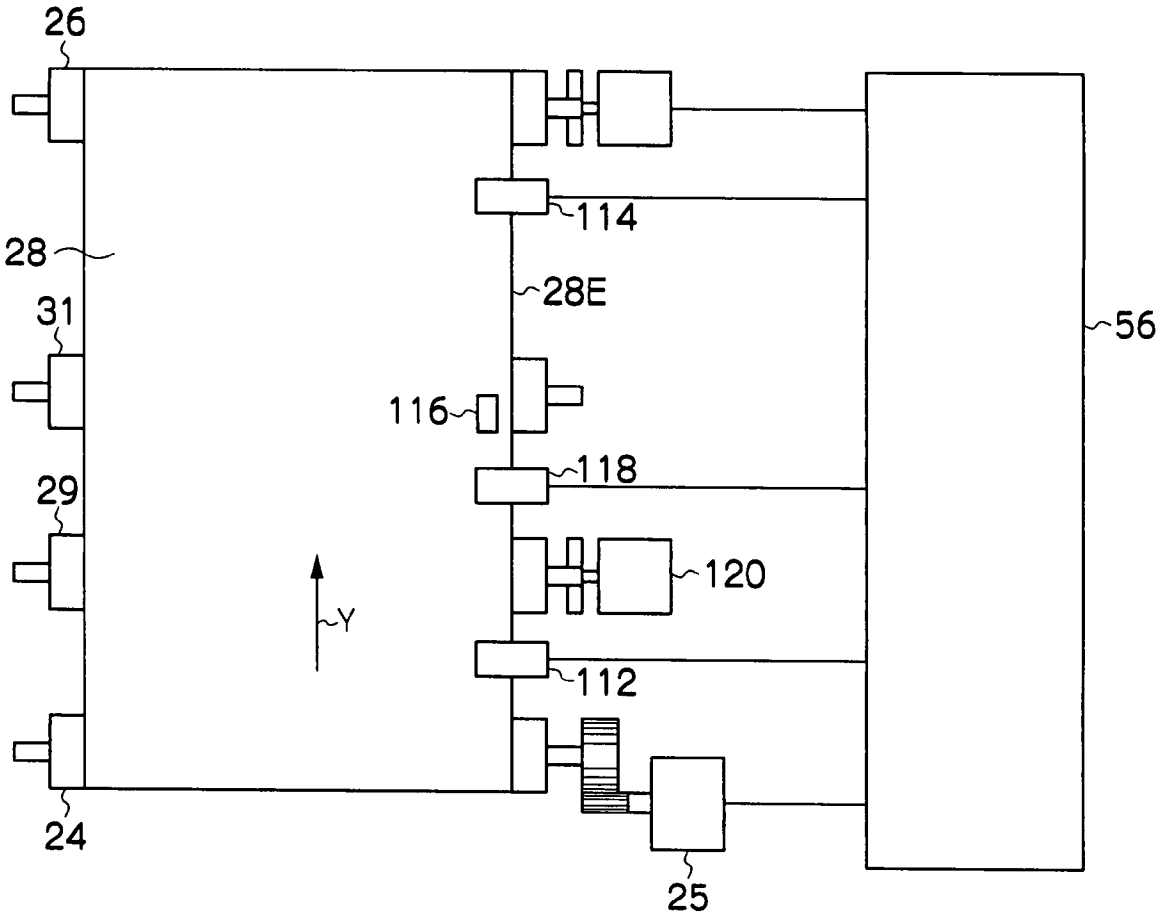
FIG. 20 is a schematic plan view showing main structural portions of the inkjet recording device relating to the first embodiment.

As shown in FIG. 20, a skewing detecting sensor 112, which measures an edge line 28E of the conveying belt 28 and detects skewing of the conveying belt 28, and a walking detecting sensor 114, which measures the edge line 28E of the conveying belt 28 and detects walking of the conveying belt 28, are provided. The skewing detecting sensor 112 and the walking detecting sensor 114 have the same structure, and may be either of contact-type or non-contact type detecting sensors, provided that they can measure the edge line 28E of the conveying belt 28. The edge line 28E of the conveying belt 28 may be measured by using a CCD. Or, a contact element may be made to contact the edge line 28E of the conveying belt 28, and the movement of the contact element may be measured by a position sensor. In the present embodiment, the skewing detecting sensor 112 is positioned further toward the downstream side in the conveying direction Y than the walking detecting sensor 114. However, either of the skewing detecting sensor 112 and the walking detecting sensor 114 may be set upstream provided that the distance therebetween is made to be as long as possible and that the both sensors are positioned at the surface opposing the recording heads.

A belt home mark 116 is formed in a vicinity of the edge line 28E of the conveying belt 28. A belt home sensor 118, which detects the belt home mark 116, is provided in the inkjet recording device relating to the present embodiment. Signals from the belt home sensor 118 are transmitted to the controller 56.

Figure 21:
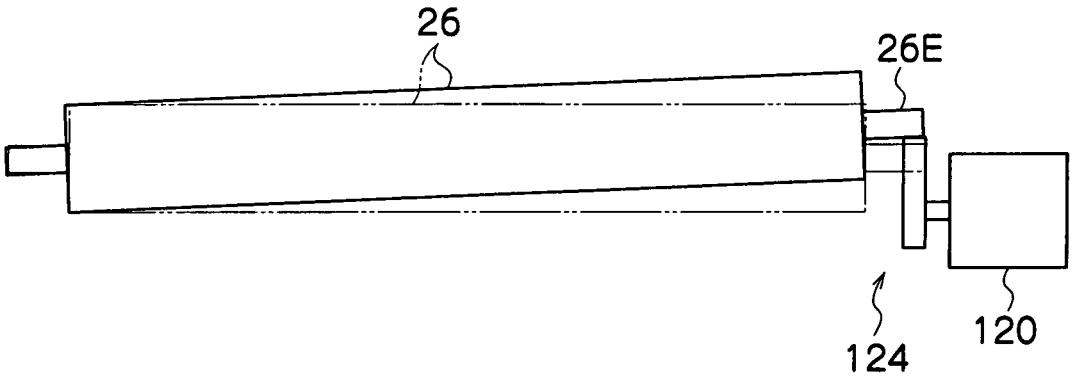
FIG. 21 is a side view showing a driven roller position correcting mechanism in the inkjet recording device relating to the first embodiment.

Torque is applied to the driving roller 24 by a driving motor 25, and the driving motor 25 is controlled by the controller 56. Further, as shown in FIG. 21, by a driven roller correcting mechanism 124, one side portion 26E, in the rotational axis direction, of the driven roller (walking adjusting roller) 26 is moved vertically by a steering motor 120 such that the position is corrected. Similarly, by a correcting mechanism which has the similar structure shown in FIG. 21, the position of the skewing adjusting roller 29 as well can be corrected, independently of the driven roller 26.

In accordance with such a structure, on the basis of the skew amount detected by the skewing detecting sensor 112 and the walking amount detected by the walking detecting sensor 114, the controller 56 controls the steering (position correction) of driven roller (walking adjusting roller) 26 and the skewing adjusting roller 29.

A skew amount S is expressed as follows, given that a walking detecting sensor output is E1 and a skewing detecting sensor output is E2.

$$S=E2-E1$$

Figure 22:
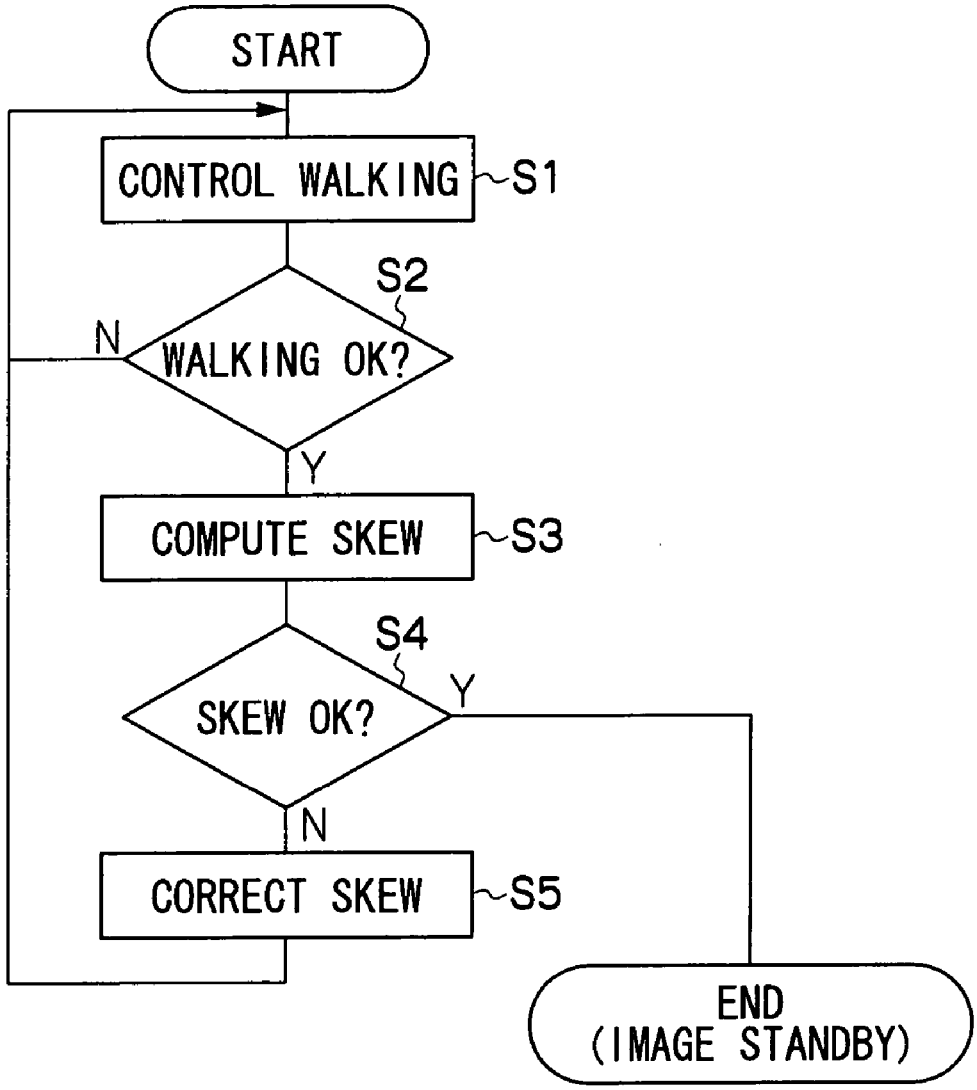
FIG. 22 is a flowchart showing the carrying-out of walking correction and skewing correction in the inkjet recording device in the first embodiment.

The processes of steering will be described hereinafter. As shown in FIG. 22, when the power source of the inkjet recording device is turned on and walking correction and skewing correction of the conveying belt 28 are started, first, the controller 56 computes the walking amount from the signal from the walking detecting sensor 114 (step S1). Then, the controller 56 determines whether or not the computed walking amount is within an allowable range which is set in advance (step S2).

If the walking amount is outside of the allowable range, the routine returns to step S1, and the controller 56 controls steering of the driven roller 26 until the walking amount is within the allowable range.

When the walking amount is within the allowable range, the controller 56 computes the skew amount from the walking amount and the signal from the skewing detecting sensor 112 (step S3).

Then, the controller 56 determines whether or not the computed skew amount is within an allowable range which is set in advance (step S4).

When the skew amount is outside of the allowable range, skewing correction is carried out (step S5), and the routine again returns to step S1.

If the skew amount is within the allowable range, the walking correction and the skewing correction are completed, and preparations for image formation are completed.

At the time of image formation (i.e., the time of ejecting ink from the inkjet recording heads), control of walking (only step S1 and step S2) is carried out, and correction of skewing is not carried out.

The correction of skewing is carried out at the time the power source is turned on, at the time a part is replaced, at the time of printing a stipulated number of sheets, at the time when a stipulated time period has elapsed, at the time when the temperature within the inkjet recording device changes, and the like.

When skewing correction is carried out, the color registration changes. Therefore, after the skewing correction is carried out, it is preferable to carry out color registration correction. A color registration control mode may be operated. However, by computing the amount of change in the color registration from the adjusted skew amount and omitting the operation of the color registration control mode, the downtime can be reduced.

Figure 6B:
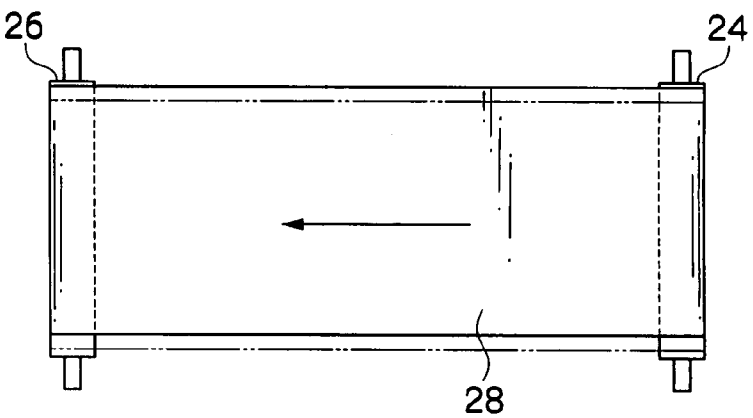
FIGS. 6A and 6B are plan views showing a normal state of the conveying belt and a state in which walking arises at the conveying belt, respectively.
Figure 6A:
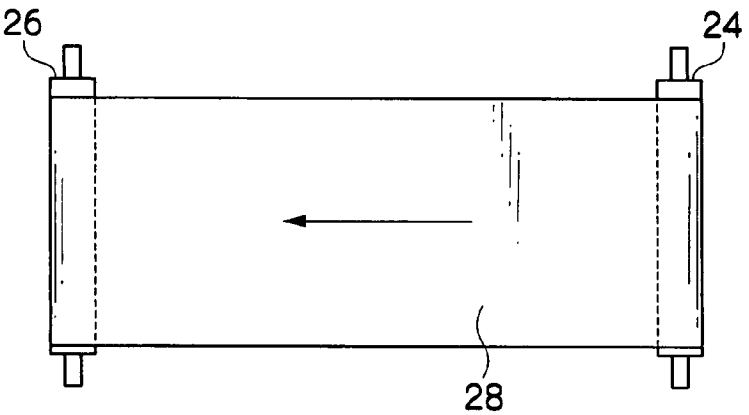
Figure 7:
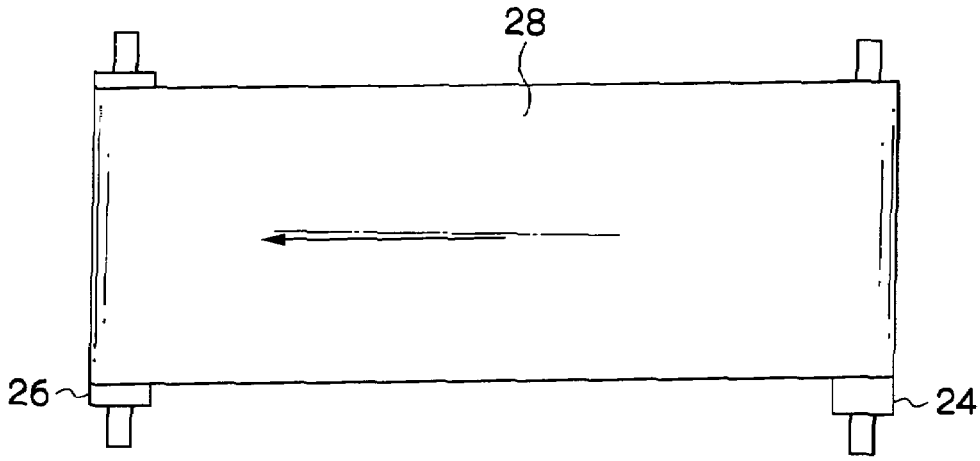
FIG. 7 is a plan view showing a state in which skewing arises at the conveying belt.
Figure 8:
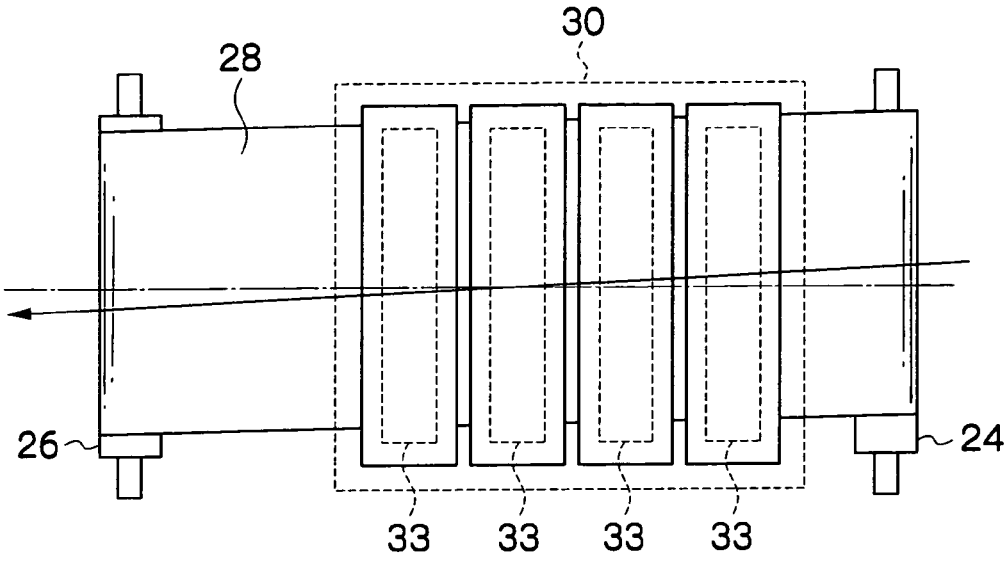
FIG. 8 is a plan view showing that skewing arises at the conveying belt in the first embodiment.
Figure 9:
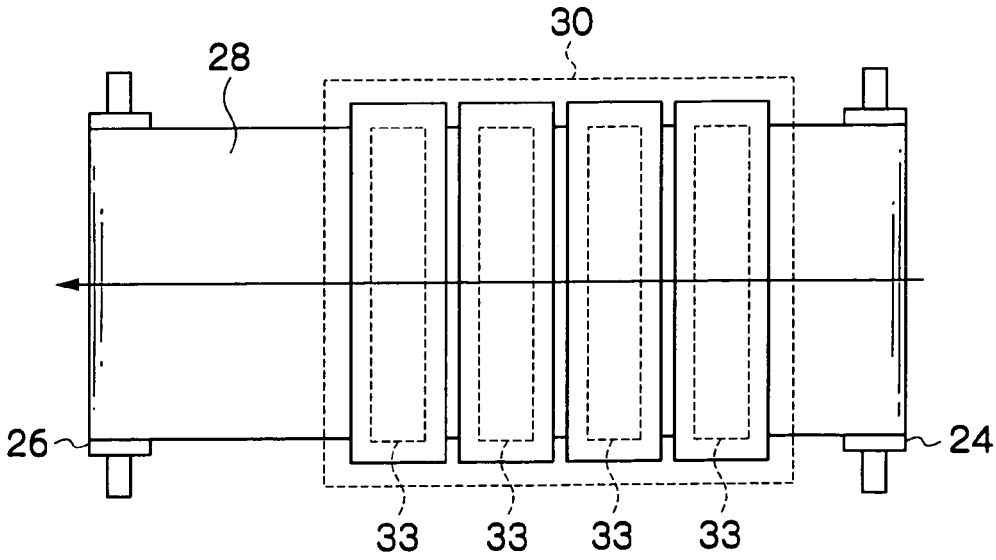
FIG. 9 is a plan view showing that the conveying belt returns to the normal state from the state shown in FIG. 8.

In the present embodiment, at the controller 56, steering of the driven roller (the walking correcting roller) 26 and the skewing adjusting roller 29 can be carried out independently of one another in this way. Accordingly, even if walking arises at the conveying belt 28 as shown in FIGS. 6A and 6B, walking correction can be carried out by steering the driven roller 26, and it is possible to return to the normal conveying state. Further, as shown in FIGS. 7 and 8, even if skewing arises at the conveying belt 28, skewing correction can be carried out by steering the skewing adjusting roller 29, and it is possible to return to the normal conveying state as shown in FIG. 9. Accordingly, the belt conveying direction can always be maintained perpendicular to the FWA-type inkjet recording head 33, and walking and skewing arising at the conveying belt 28 can be prevented steadily. Therefore, a good image, in which white stripes and black stripes do not arise, can be obtained. Further, because skewing and walking of the belt do not arise, miss color registration and distortion of the image also can be prevented. With regard to miss color registration and distortion of the image, the present invention is also effective with respect to inkjet recording devices of a type that scans recording heads perpendicularly to the sheet conveying direction.

Figure 10:
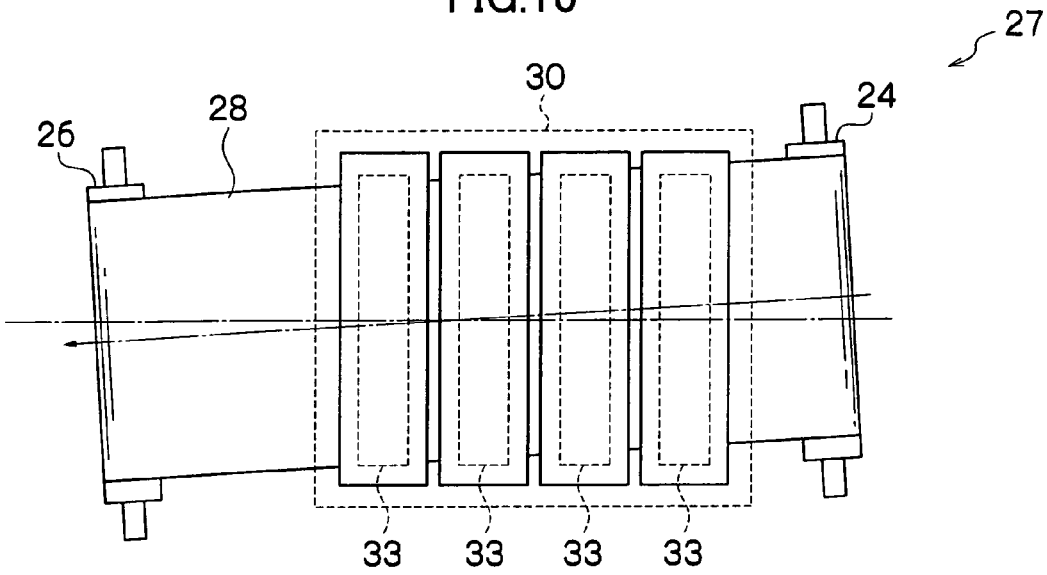
FIG. 10 is a plan view showing that alignment of the inkjet recording head and a conveying unit cannot be adjusted sufficiently at a time of assembly in the first embodiment.
Figure 11:
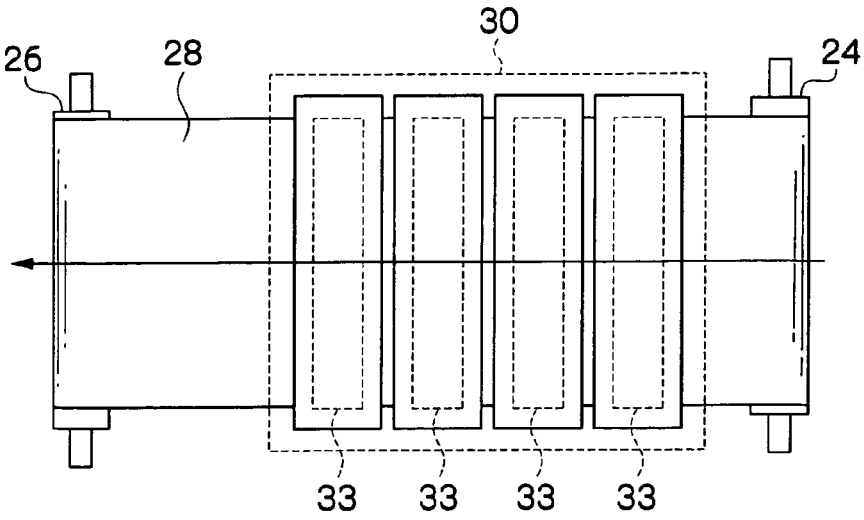
FIG. 11 is a plan view showing that the conveying belt returns to the normal state from the state shown in FIG. 10.

Further, as shown in FIG. 10, even when the alignment of the recording head array 30 and the conveying unit 27 cannot be sufficiently adjusted at the time of assembly and a state which is equivalent to skewing arises, walking correction and skewing correction are carried out, and it is possible to return to the normal conveying state as shown in FIG. 11.

Figure 12:
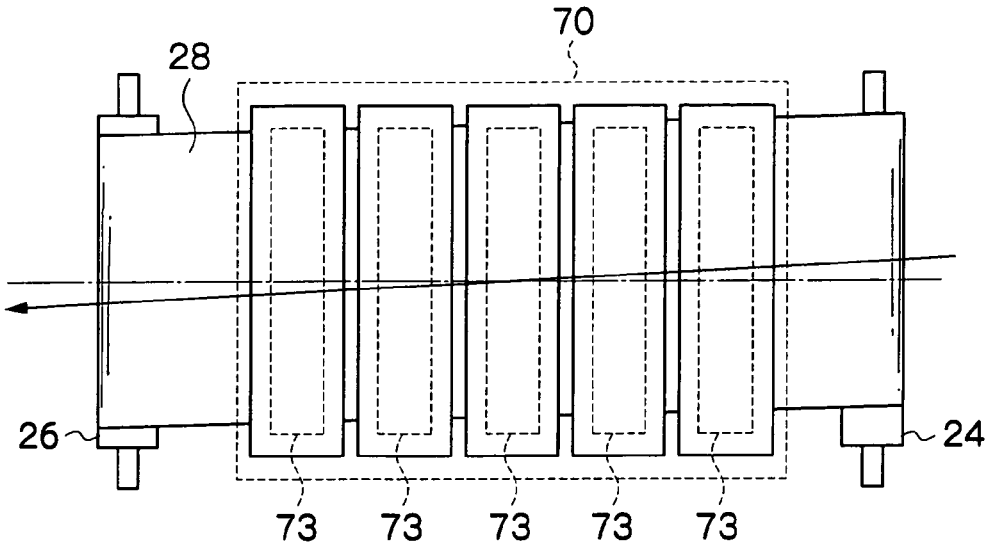
FIG. 12 is a plan view showing that skewing arises at the conveying belt in a modified example of the first embodiment.
Figure 13:
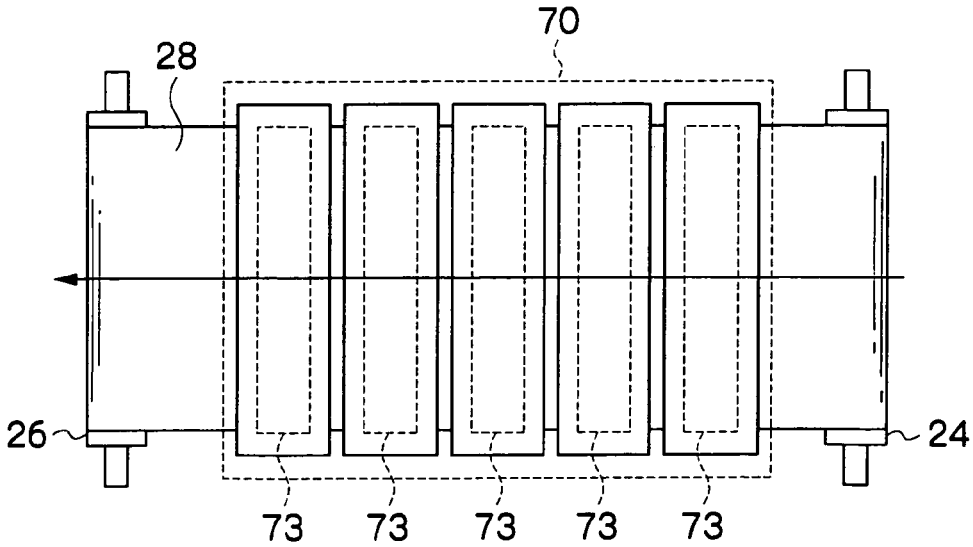
FIG. 13 is a plan view showing that the conveying belt returns to a normal state from the state shown in FIG. 12.

Note that, as shown in FIGS. 12 and 13, even if a recording head array 70 is provided which has inkjet recording heads 73 which apply a processing liquid (T) other than ink, the walking correction and the skewing correction can be carried out independently of one another, and it is possible to return to the normal conveying state (see FIG. 13 for example).

Figure 5:
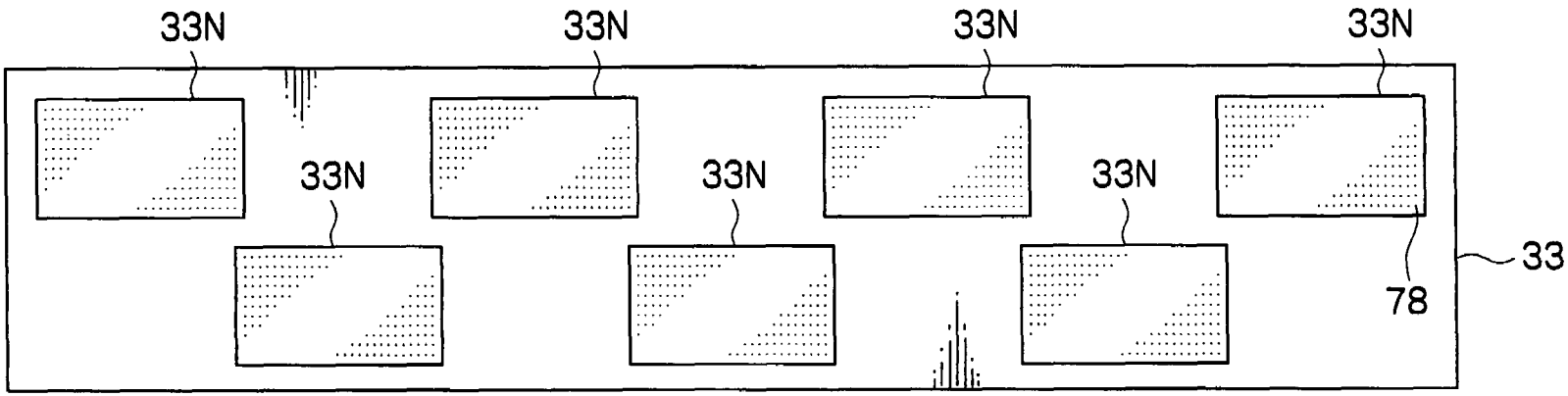
FIG. 5 is a rear view showing the structure of an inkjet recording head in the first embodiment.
Figure 14:
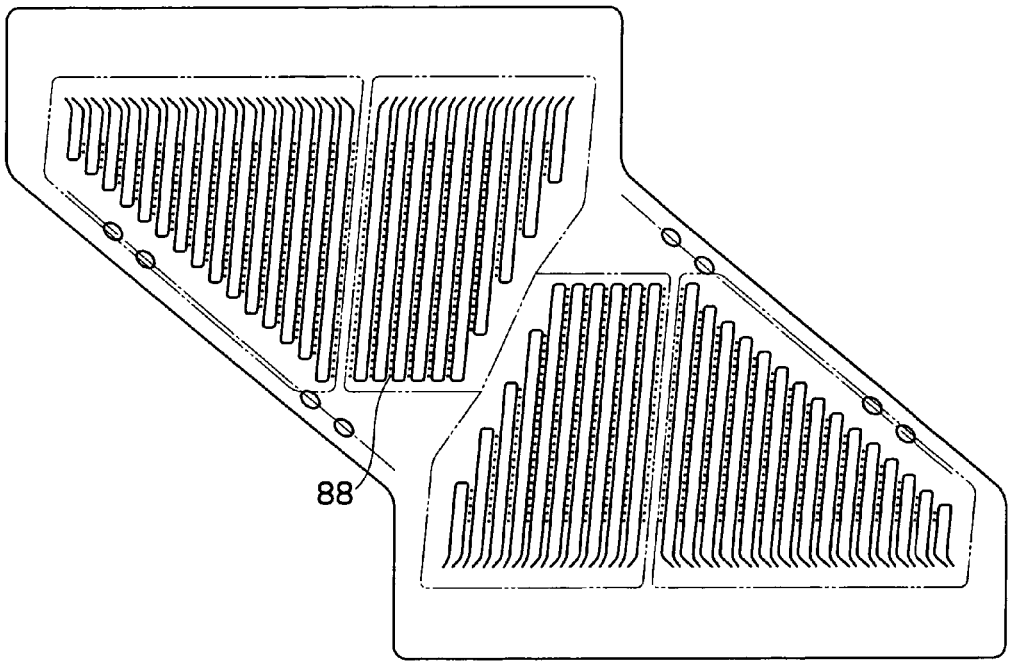
FIG. 14 is a rear view showing a modified example of an arrangement of ejecting nozzles in the first embodiment.
Figure 15:
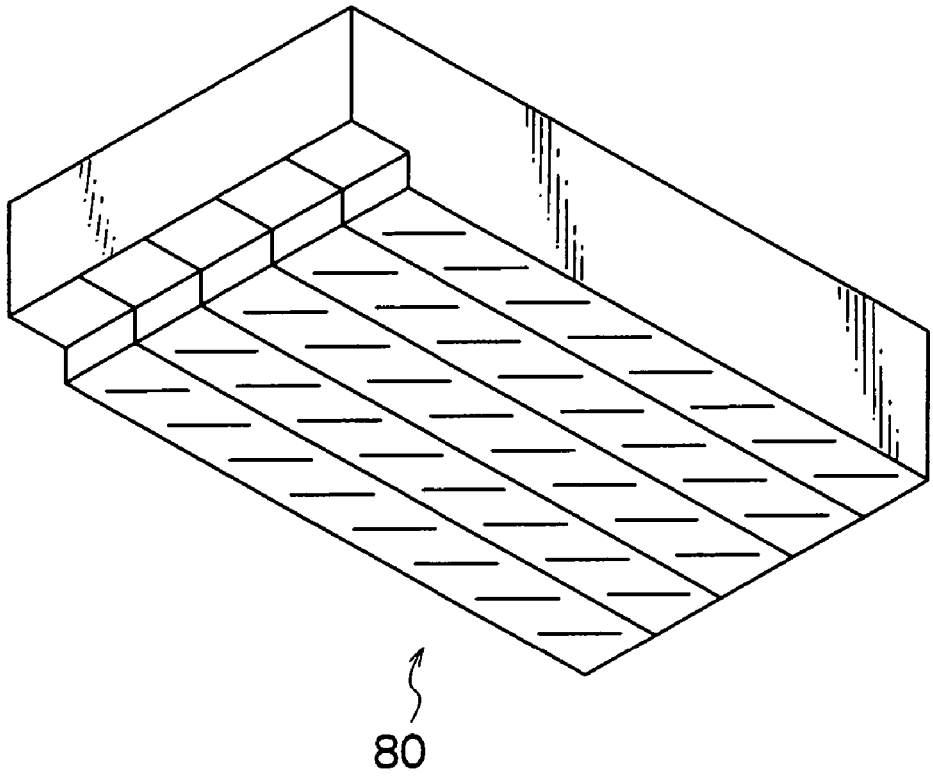
FIG. 15 is a rear perspective view of an inkjet recording head in which the ejecting nozzles shown in FIG. 14 are arranged.
Figure 16:
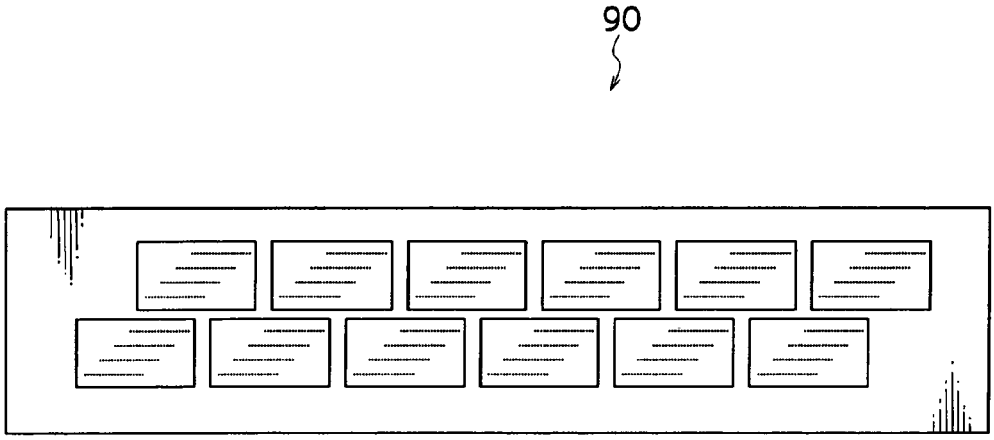
FIG. 16 is a rear view showing a modified example of an arrangement of ejecting nozzles in the first embodiment.
Figure 17:
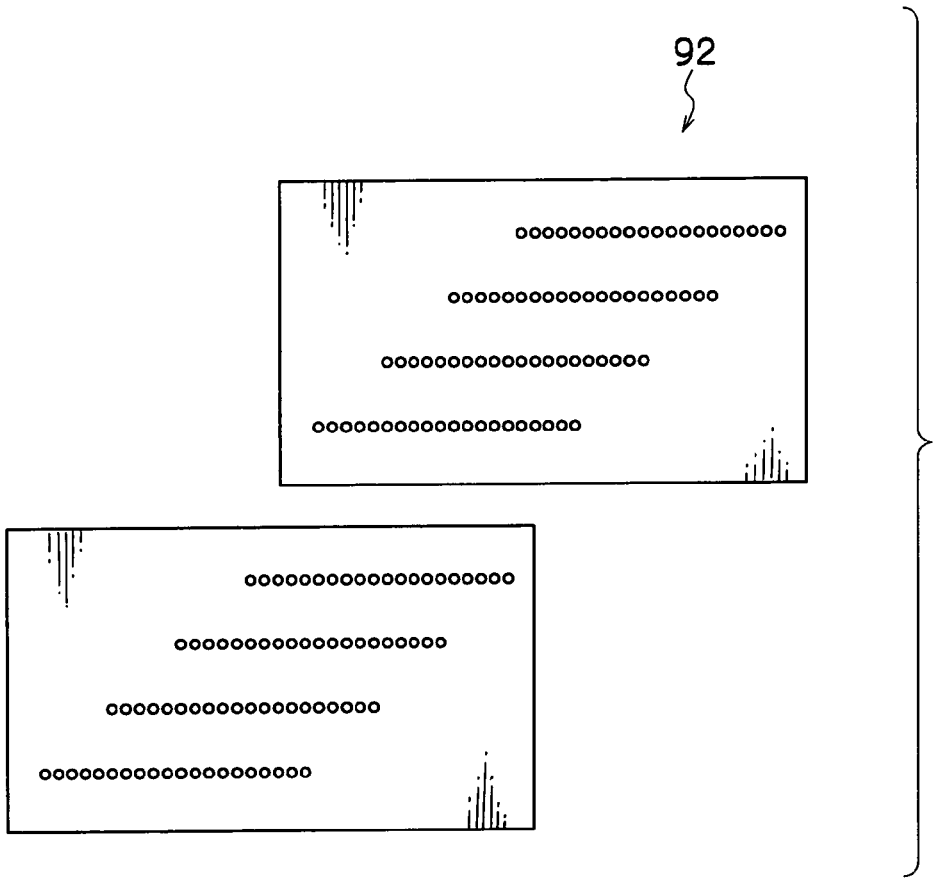
FIG. 17 is a rear view showing a modified example of an arrangement of ejecting nozzles in the first embodiment.
Figure 18:
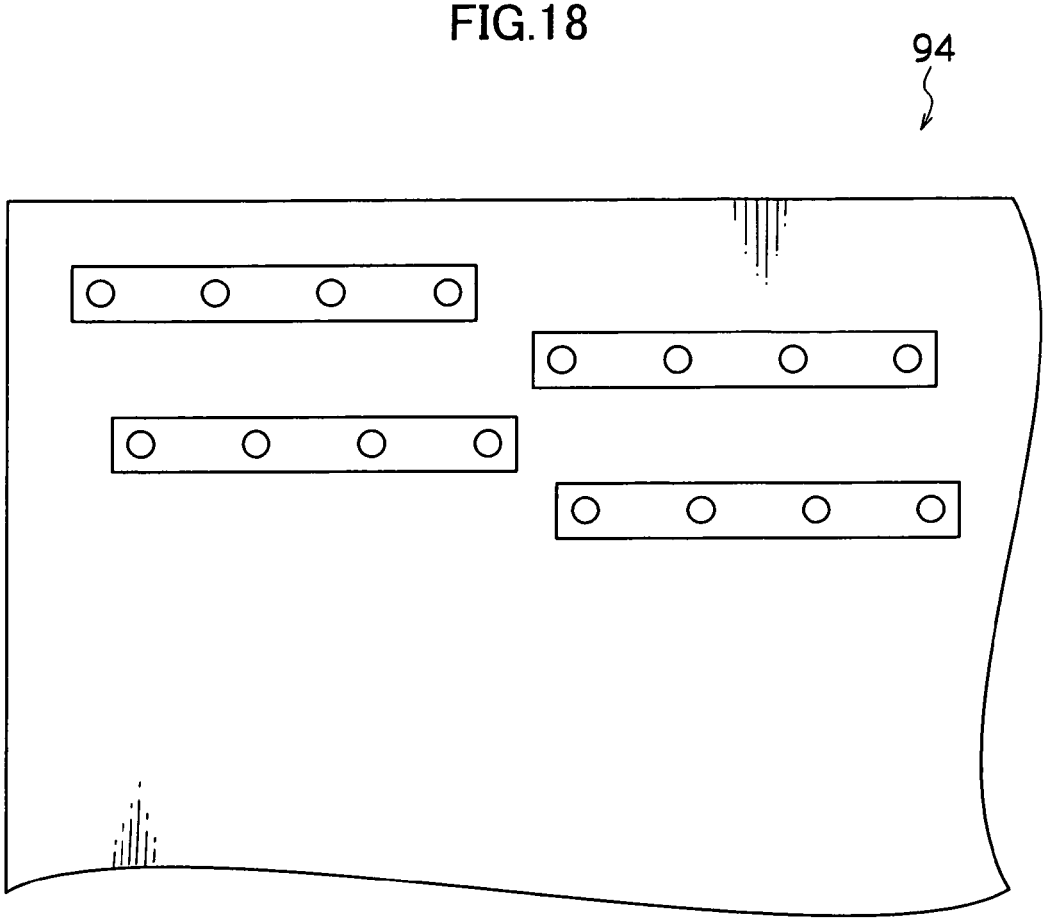
FIG. 18 is a rear view showing a modified example of an arrangement of ejecting nozzles in the first embodiment.
Figure 19:
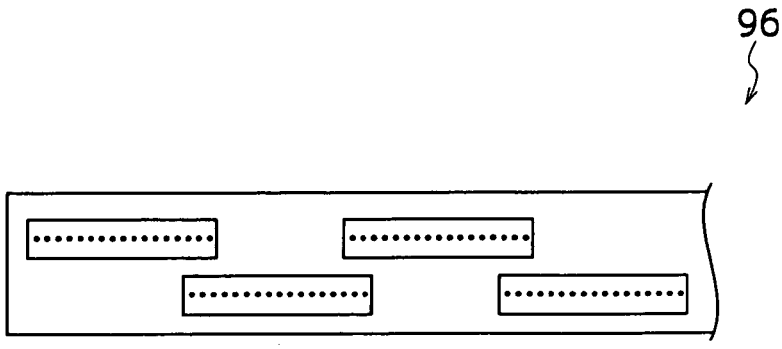
FIG. 19 is a rear view showing a modified example of an arrangement of ejecting nozzles in the first embodiment.

Further, the arrangement of the ejecting nozzles may be a general arrangement other than that shown in FIG. 5. For example, a recording head array 80 (see FIG. 15), in which ejecting nozzles 88 such as shown in FIG. 14 are arranged, may be provided. Or, inkjet recording heads 90, 92, 94, 96, in which ejecting nozzles are arranged as shown in FIGS. 16 through 19, may be provided.

Figure 23A:
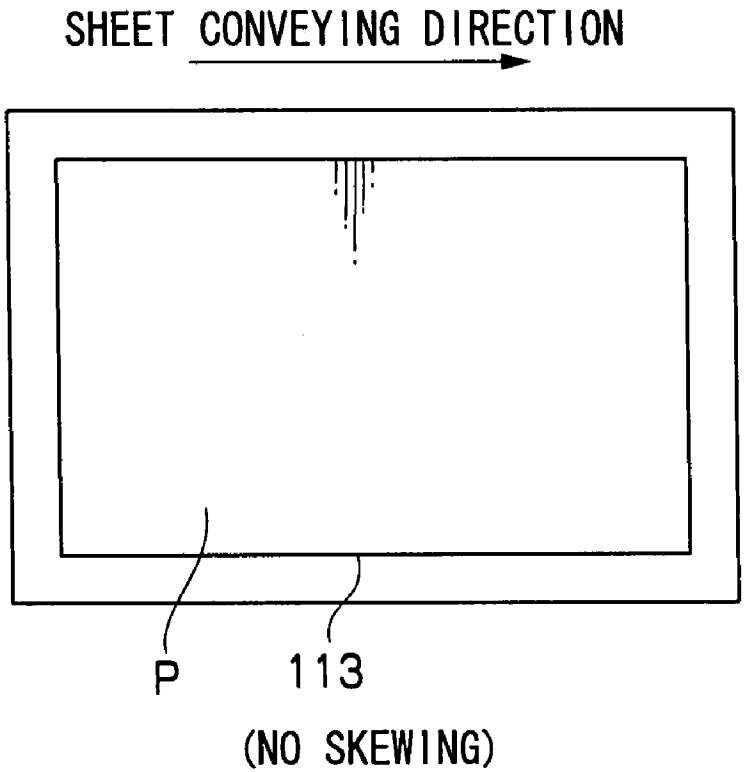
FIGS. 23A and 23B are plan views showing that the fact that skewing arises at the conveying belt is detected by a test pattern.
Figure 23B:
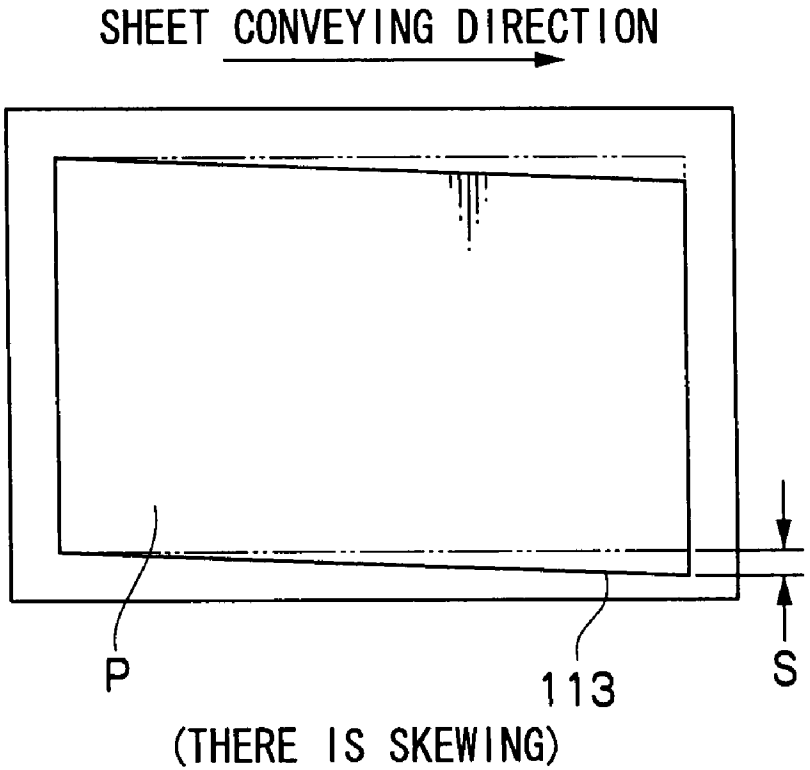

Note that, even if the skewing detecting sensor 112 detects a test pattern 113 formed on the sheet P as shown in FIGS. 23A and 23B, and not the edge line 28E, the skew amount S can be detected similarly, and skewing correction is possible.

In the case of the test pattern 113, visual perception and measuring by an operator or the like also are possible.

SECOND EMBODIMENT

Figure 24:
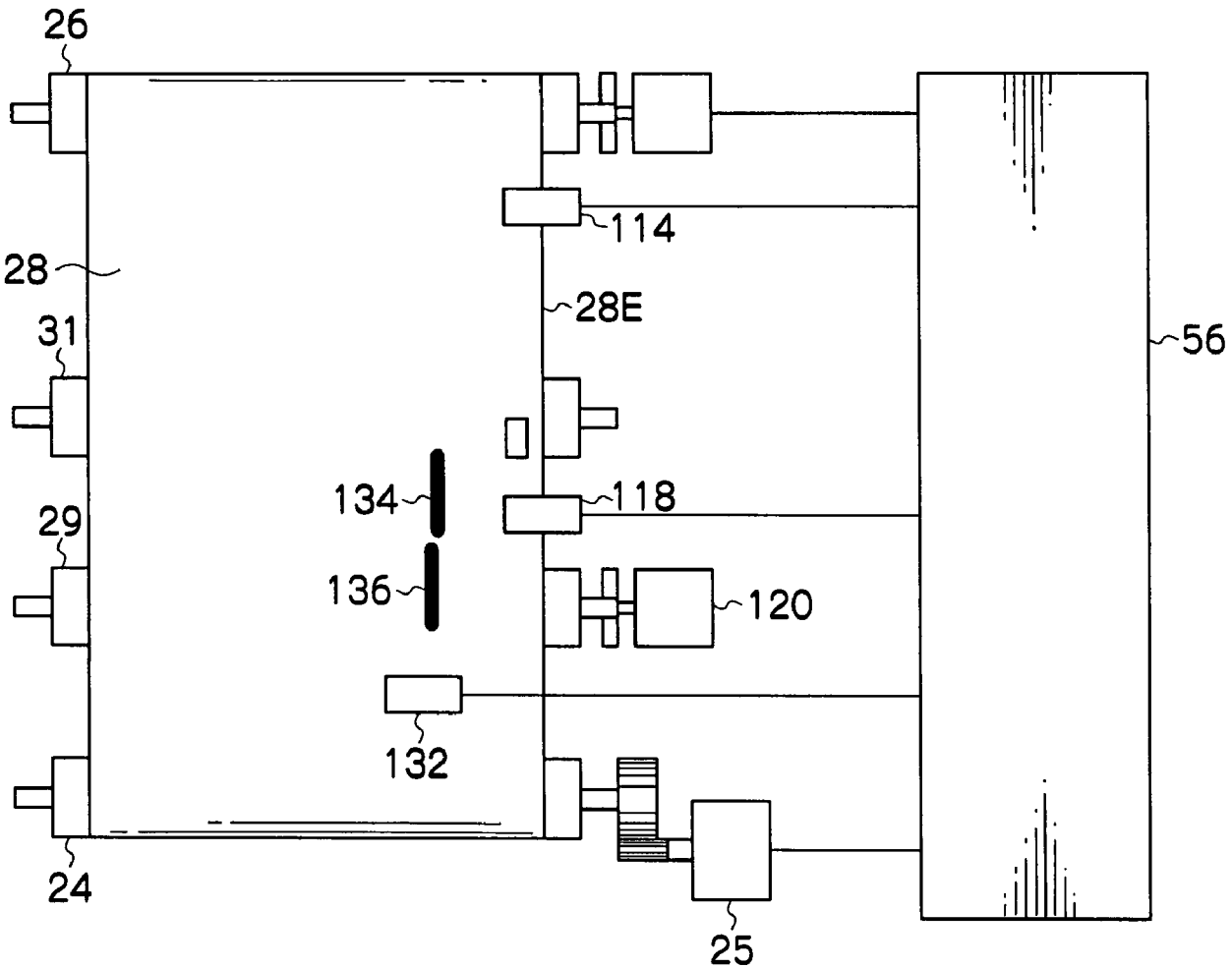
FIG. 24 is a schematic plan view showing main structural portions of an inkjet recording device relating to a second embodiment.

A second embodiment will be described next. As shown in FIG. 24, in the present embodiment, as compared with the first embodiment, a registration detecting sensor 132, which detects a color registration pattern, is provided instead of the skewing detecting sensor 112. The color registration pattern is a test pattern which is for detecting miss color registration and which is formed on the sheet conveying belt or the recording sheet, in order to prevent miss color registration which arises due to the assembly position accuracy of the recording heads of the respective colors, the ejecting timing accuracy, or the conveying accuracy of the sheet conveying belt being insufficient, or when the environment, the set state, the temperature within the apparatus, or the like changes. The test pattern is mainly structured by patterns in which lines of the respective colors are formed at uniform intervals, and the configuration thereof is not limited provided that miss color registration can be detected. The registration detecting sensor 132 measures the pattern interval by a CCD sensor, or measures reflection timings of the lines of the respective colors of the color registration patterns by an optical sensor, and computes the miss color registration amount. A signal from the registration detecting sensor 132 is transmitted to the controller 56.

Note that, rather than detection by a sensor, detection and determination may be carried out visually.

In the present embodiment, color registration patterns 134, 136 for testing are formed on the conveying belt 28 or the sheet, and the miss color registration on the conveying belt 28 or the sheet is measured. The registration adjustment value is equivalent to the color registration in the direction perpendicular to the sheet conveying direction. Therefore, by linking these, the skew amount can be computed. After the skew amount is detected, step S4 described in the first embodiment is carried out, and thereafter, skewing correction and walking correction are carried out in the same way as in the first embodiment.

The present embodiment can achieve the same effects as the first embodiment, without using the skewing detecting sensor. Further, in the first embodiment, because there is independent control of the skewing of the conveying belt 28, errors relating to the relative position between the FWA head and the conveying belt 28 require a separate correction. In the present embodiment, because skewing, which includes the positional relationship between the FWA head and the conveying belt 28, can be detected and corrected, more stable image quality can be obtained.

THIRD EMBODIMENT

Figure 25:
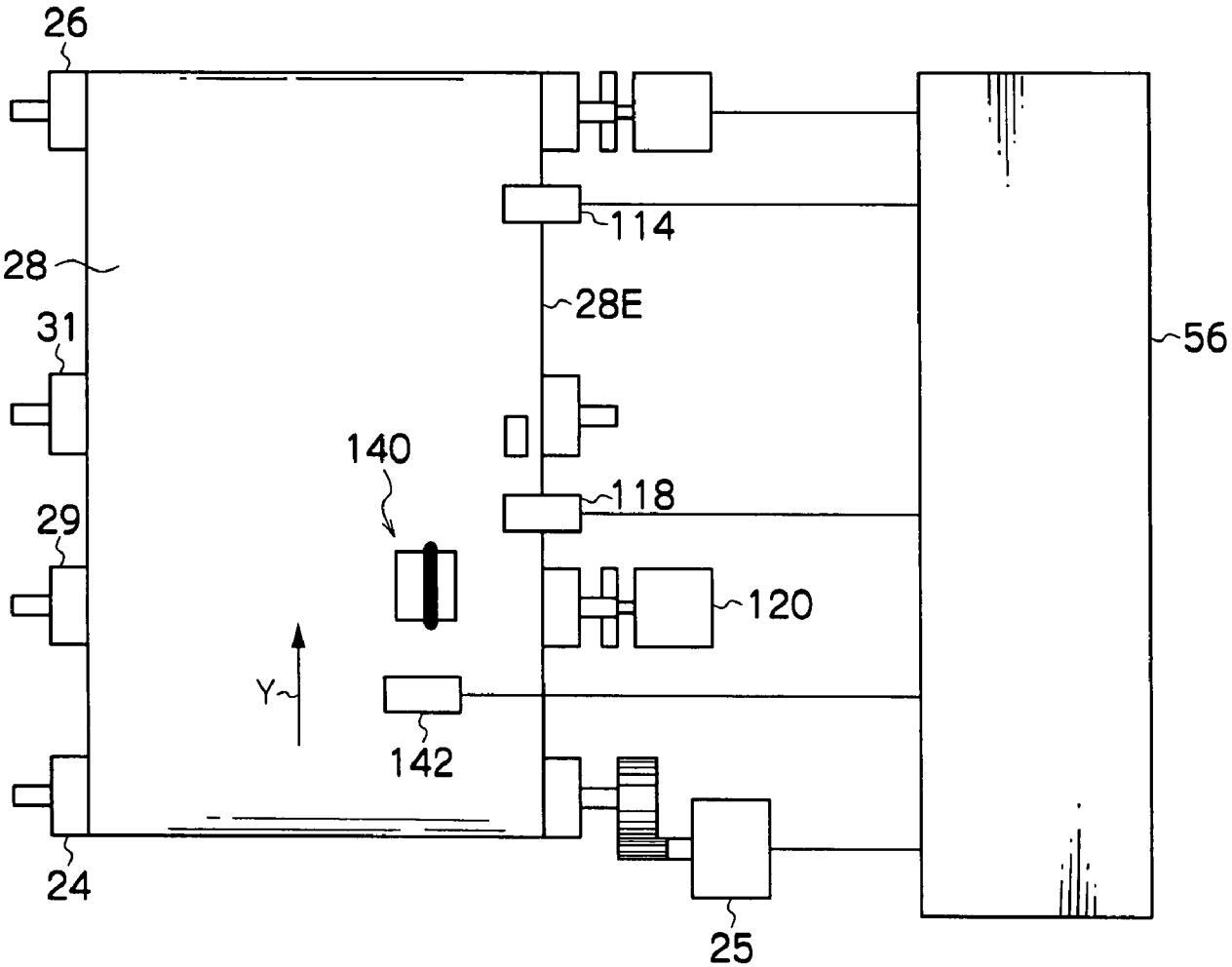
FIG. 25 is a schematic plan view showing main structural portions of an inkjet recording device relating to a third embodiment.

A third embodiment will be described next. As shown in FIG. 25, in the present embodiment, as compared with the first embodiment, a density detecting sensor 142, which detects the density of a skewing detection pattern 140 for testing, is provided instead of the skewing detecting sensor 112. The density detecting sensor 142 is disposed so as to correspond to a position at which, in the intervals between adjacent ejecting nozzles, the components, in the direction parallel to the conveying direction of the recording medium, are not uniform (a position at which the ejecting nozzle rows are jointed). The signal from the density detecting sensor 142 is transmitted to the controller 56.

In the present embodiment, the skewing detection pattern 140 for testing is formed on the conveying belt 28 or the sheet, and the change in density on the conveying belt 28 or the sheet is detected.

Figure 26:
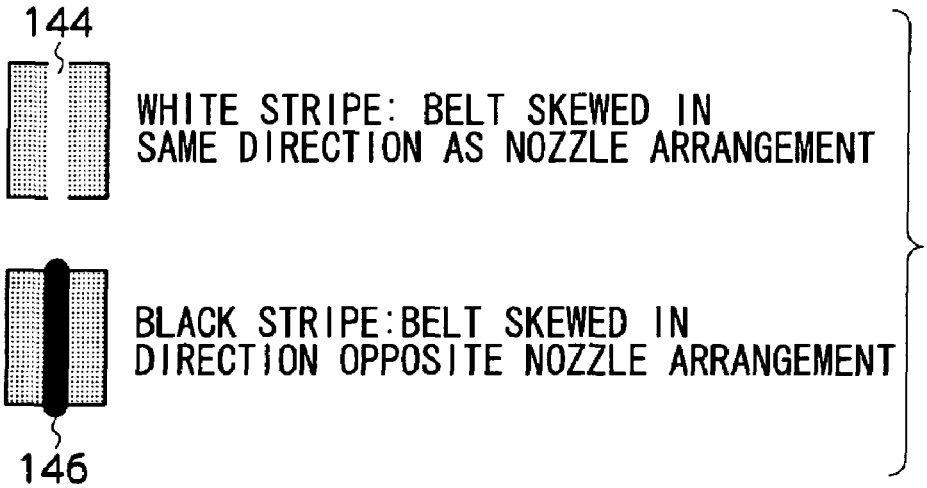
FIG. 26 is a schematic diagram showing that a white stripe and a black stripe are drawn on a recording sheet in the third embodiment.

Here, as shown in FIG. 26, in a case in which a white stripe 144 is formed, the conveying belt 28 is skewed in the same direction as the nozzle arrangement. In a case in which a black stripe 146 is formed, the conveying belt 28 is skewed in the direction opposite to the nozzle arrangement.

The density detecting sensor 142 determines the light/dark shading by measuring the reflected light amount.

Figure 27:
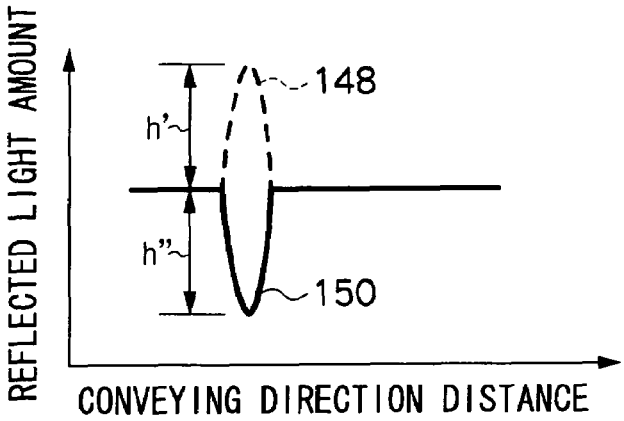
FIG. 27 is a graph showing that a white stripe and a black stripe are detected at a CCD sensor in the third embodiment.
Figure 28:
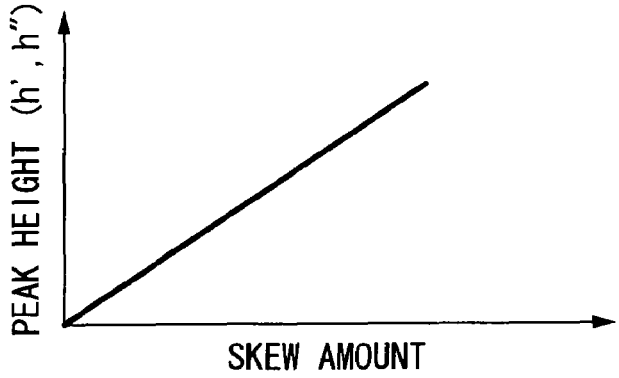
FIG. 28 is a graph showing the relationship between skew amount and peak height in the graph of FIG. 27.

Accordingly, when a CCD sensor is provided as the density detecting sensor 142, in a case in which the white stripe 144 is formed, a peak 148 where the reflected light amount increases is detected (the broken line in FIG. 27), whereas, in a case in which the black stripe 146 is formed, a peak 150 where the reflected light amount decreases is detected (the solid line in FIG. 27). Further, the greater the skew amount, the greater the peak height h', h" (the difference in heights at the peak apex portion and the portion where there is no peak) (see FIG. 28).

Figure 29:
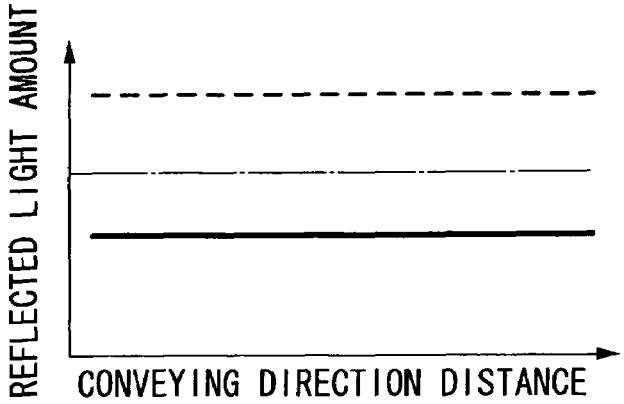
FIG. 29 is a graph showing that a white stripe and a black stripe are detected at a light amount sensor in the third embodiment.
Figure 30A:
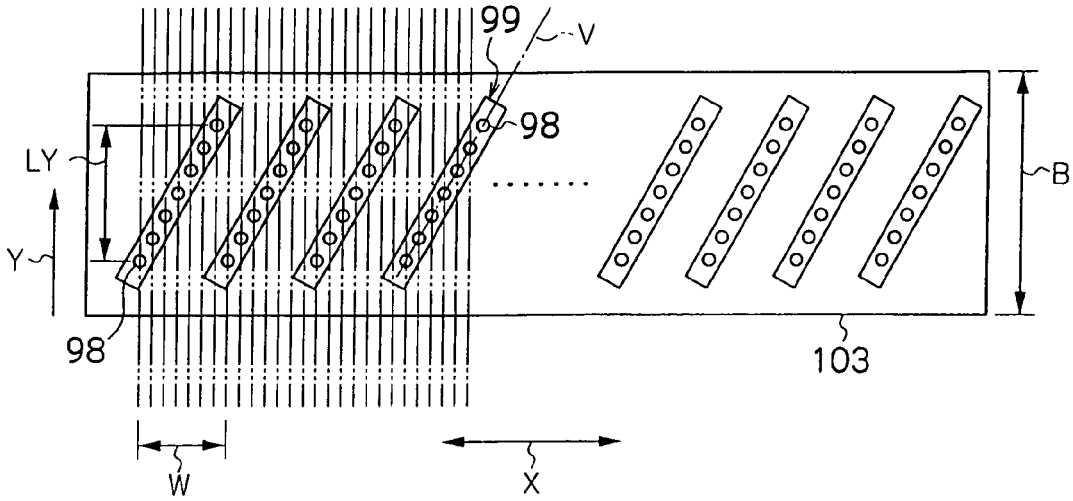
FIG.30A Prior Art
FIGS. 30A and 30B are respectively a rear view showing an arrangement of ejecting nozzles of an inkjet recording head and an enlarged plan view showing positions of ink droplets ejected from the ejecting nozzles, in a conventional art.
Figure 30B:
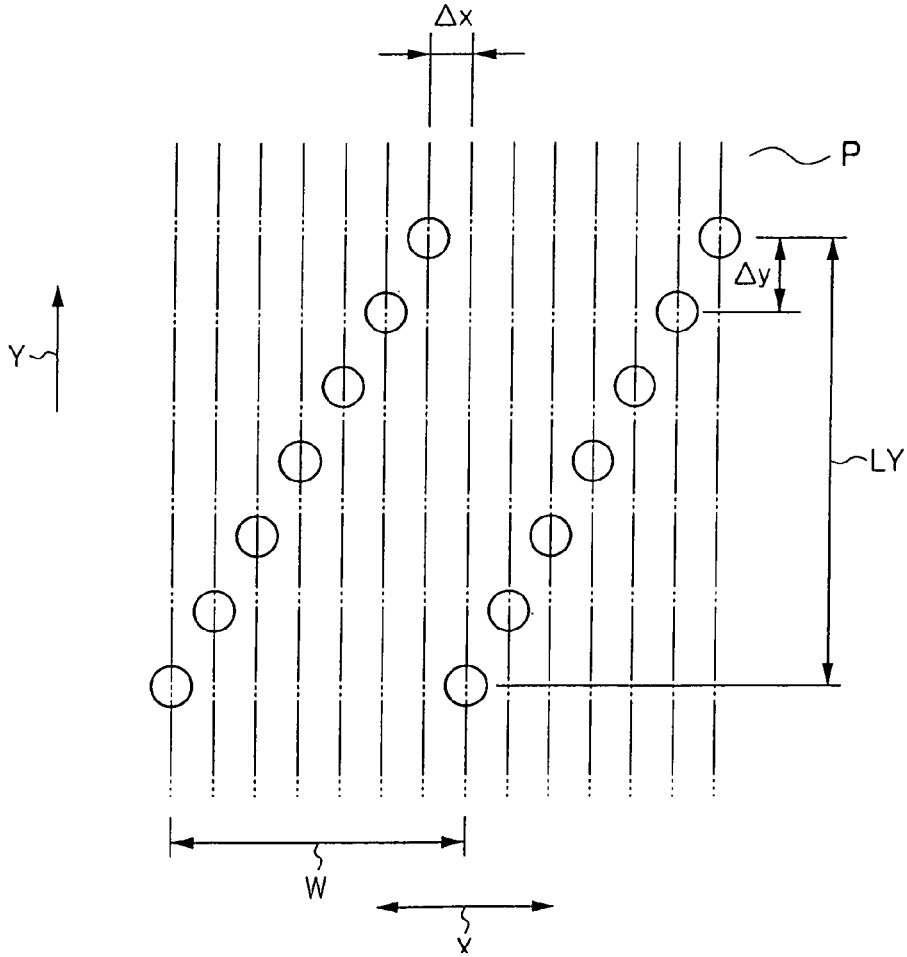
FIG.30B Prior Art
Figure 31A:
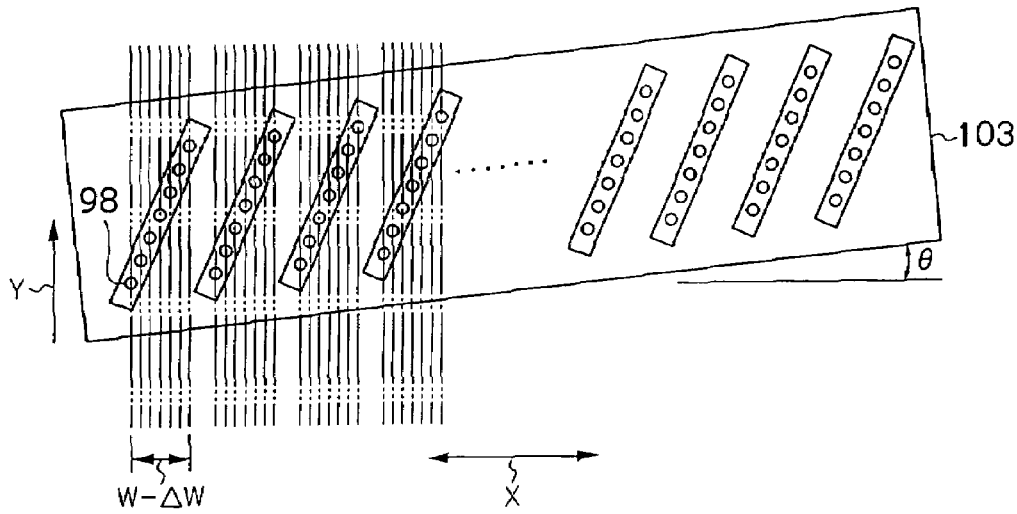
FIG.31A Prior Art
FIGS. 31A and 31B are respectively a rear view showing an arrangement of ejecting nozzles of an inkjet recording head and an enlarged plan view showing positions of ink droplets ejected from the ejecting nozzles, in a conventional art.
Figure 31B:
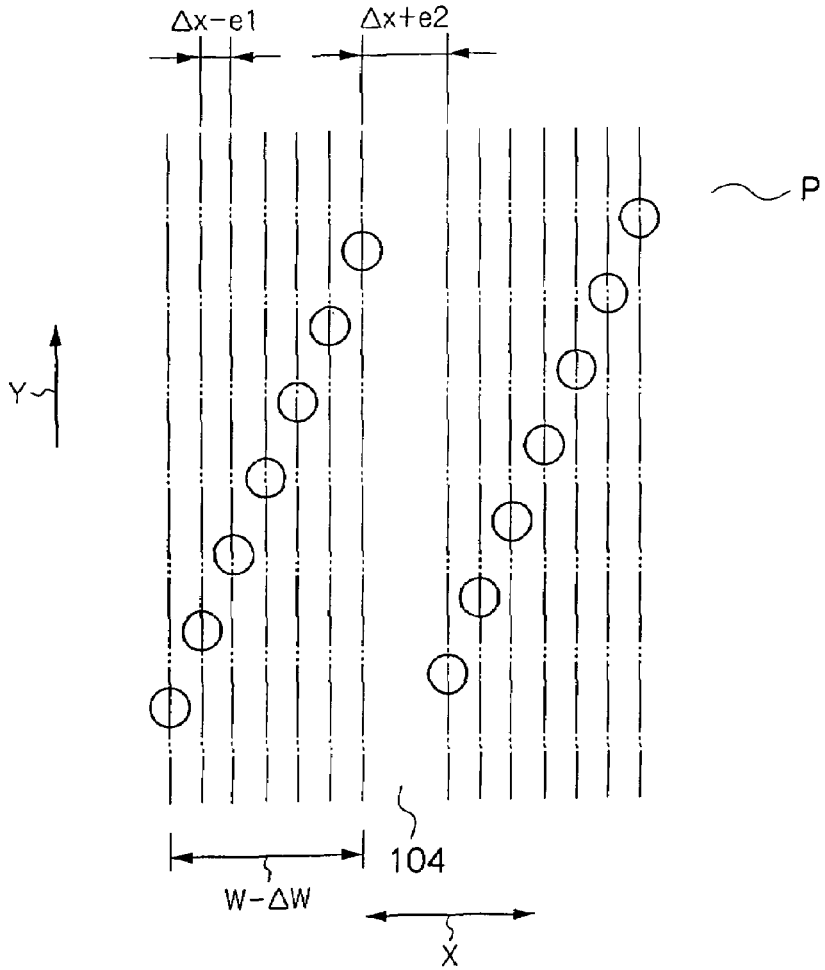
FIG.31B Prior Art
Figure 32A:
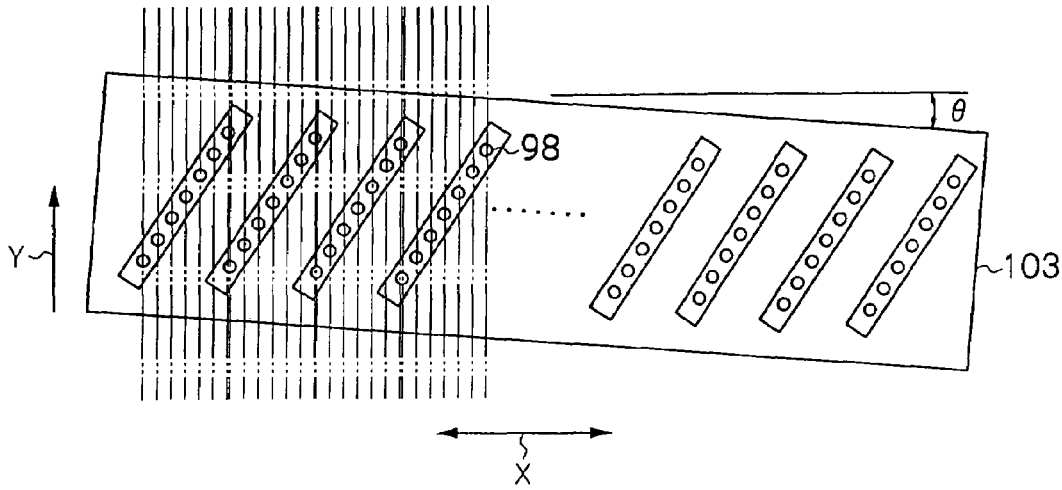
FIG.32A Prior Art
FIGS. 32A and 32B are respectively a rear view showing an arrangement of ejecting nozzles of an inkjet recording head and an enlarged plan view showing positions of ink droplets ejected from the ejecting nozzles, in a conventional art.
Figure 32B:
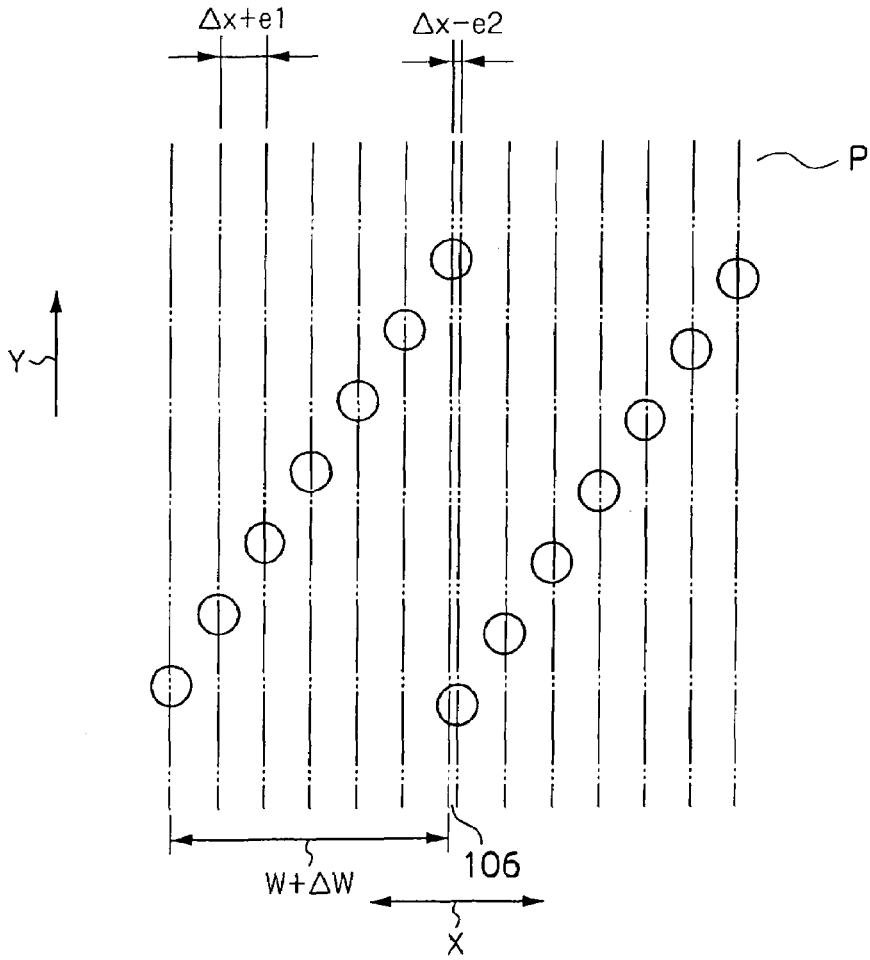
FIG.32B Prior Art

Further, when a light amount sensor is provided as the density detecting sensor 142, in a case in which the white stripe 144 is formed, the reflected light amount increases on average (the broken line in FIG. 29), whereas, in a case in which the black stripe 146 is formed, the reflected light amount decreases on average (the solid line in FIG. 29).

Note that, rather than detection by a sensor, detection and determination may be carried out visually.

In accordance with the present embodiment, the same effects as those of the first embodiment can be achieved, without using a skewing detecting sensor. Further, differently than the first and second embodiments, control is carried out directly on the basis of white and black stripes. Therefore, white and black stripes can be prevented reliably, and even more stable image quality can be obtained.

Embodiments of the present invention are described above by using examples, but these are merely examples, and the present invention can be implemented by making various modifications falling within a scope which does not deviate from the gist of the present invention. Further, the scope of the right of the present invention is, of course, not limited to the above-described embodiments.

In the aspect of the present invention, it is possible that ink droplets are ejected as the liquid droplets, and image formation is carried out.

In the aspect of the present invention, it is possible that the ejecting nozzles form a plurality of ejecting nozzle rows, the ejecting nozzle rows are arranged along one direction so as to be parallel to one another, in intervals between the ejecting nozzles which are adjacent in a direction orthogonal to a conveying direction of the recording medium, components in the direction orthogonal to a conveying direction of the recording medium are uniform, and in the intervals between the ejecting nozzles which are adjacent in the direction orthogonal to a conveying direction of the recording medium, components in a direction parallel to the conveying direction of the recording medium are not uniform.

In the aspect of the present invention, it is possible that the liquid droplet ejecting device further includes a skewing detecting section which detects skewing of the conveying belt; and a walking detecting section which detects walking of the conveying belt, wherein, on the basis of a skew amount detected by the skewing detecting section and a walking amount detected by the walking detecting section, the control section controls the position corrections of the at least two rollers.

In the aspect of the present invention, it is possible that the liquid droplet ejecting device forms a color image, and the skewing detecting section has a detecting section which detects a color registration pattern formed on one of the recording medium and the conveying belt, and the skewing detecting section detects the skew amount of the conveying belt on the basis of a detected position of the color registration pattern.

In the aspect of the present invention, it is possible that the skewing detecting section has a detecting section which detects a position of an end portion of the conveying belt.

In the aspect of the present invention, it is possible that the skewing detecting section has a detecting section which detects a test pattern formed on one of the recording medium and the conveying belt.

In the aspect of the present invention, it is possible that the skewing detecting section has a density detecting section, and detects the skew amount on the basis of a change in density of a test pattern formed on one of the recording medium and the conveying belt.

In the aspect of the present invention, it is possible that a placement position of the density detecting section is set so as to correspond to a position at which, in the intervals between the adjacent ejecting nozzles of the liquid droplet ejecting head, components in the direction parallel to the conveying direction of the recording medium are not uniform.

In the aspect of the present invention, it is possible that the walking detecting section has a detecting section which detects a position of an end portion of the conveying belt.

In the aspect of the present invention, it is possible that an inputting section which inputs data corresponding to control of the position correction of the at least two rollers is provided, and the control section controls the position corrections of the at least two rollers on the basis of the data inputted by the inputting section.

What is claimed is:

1. A liquid droplet ejecting device comprising:

a liquid droplet ejecting head at which an arrangement of ejecting nozzles which eject liquid droplets is formed in two-dimensions; and a conveying section which conveys a recording medium at a side to be ejected by the liquid droplet ejecting head, wherein the conveying section has:

an endless conveying belt on which the recording medium is placed and which passes by the side to be ejected by the liquid droplet ejecting head;

a skewing adjusting roller that abuts the conveying belt and adjusts skewing of the conveying belt, whose position can be corrected;

a walking adjusting roller that abuts the conveying belt and adjusts walking of the conveying belt, whose position can be corrected; and a control section which independently controls position corrections of the skewing adjusting roller and the walking adjusting roller.

2. The liquid droplet ejecting device of claim 1, wherein ink droplets are ejected as the liquid droplets, and image formation is carried out.

3. The liquid droplet ejecting device of claim 2, wherein the ejecting nozzles form a plurality of ejecting nozzle rows, the ejecting nozzle rows are arranged along one direction so as to be parallel to one another, in intervals between the ejecting nozzles which are adjacent in a direction orthogonal to a conveying direction of the recording medium, components in the direction orthogonal to a conveying direction of the recording medium are uniform, and in the intervals between the ejecting nozzles which are adjacent in the direction orthogonal to a conveying direction of the recording medium, components in a direction parallel to the conveying direction of the recording medium are not uniform.

4. The liquid droplet ejecting device of claim 3, further comprising:

a skewing detecting section which detects skewing of the conveying belt; and a walking detecting section which detects walking of the conveying belt, wherein, on the basis of a skew amount detected by the skewing detecting section and a walking amount detected by the walking detecting section, the control section controls the position corrections of the skewing adjusting roller and the walking adjusting roller.

5. The liquid droplet ejecting device of claim 4, wherein the liquid droplet ejecting device forms a color image, and the skewing detecting section has a detecting section which detects a color registration pattern formed on one of the recording medium and the conveying belt, and the skewing detecting section detects the skew amount of the conveying belt on the basis of a detected position of the color registration pattern.

6. The liquid droplet ejecting device of claim 4, wherein the skewing detecting section has a detecting section which detects a position of an end portion of the conveying belt.

7. The liquid droplet ejecting device of claim 4, wherein the skewing detecting section has a detecting section which detects a test pattern formed on one of the recording medium and the conveying belt.

8. The liquid droplet ejecting device of claim 4, wherein the skewing detecting section has a density detecting section, and detects the skew amount on a basis of a change in density of a test pattern formed on one of the recording medium and the conveying belt.

9. The liquid droplet ejecting device of claim 8, wherein a placement position of the density detecting section is set so as to correspond to a position at which the ejecting nozzle rows are jointed.

10. The liquid droplet ejecting device of claim 4, wherein the walking detecting section has a detecting section which detects a position of an end portion of the conveying belt.

11. The liquid droplet ejecting device of claim 3, wherein an inputting section which inputs data corresponding to control of the position correction of the at least two rollers is provided, and the control section controls the position corrections of the skewing adjusting roller and the walking adjusting roller on the basis of the data inputted by the inputting section.

12. A liquid droplet ejecting device comprising:

a liquid droplet ejecting head at which an arrangement of ejecting nozzles which eject liquid droplets is formed in two-dimensions;

a conveying section which conveys a recording medium at a side to be ejected by the liquid droplet ejecting head, an endless conveying belt on which the recording medium is placed and which passes by the side to be ejected by the liquid droplet ejecting head;

a skewing adjusting roller that abuts the conveying belt and adjusts skewing of the conveying belt, whose position can be corrected;

a walking adjusting roller that abuts the conveying belt and adjusts walking of the conveying belt, whose position can be corrected;

a skewing adjusting roller correcting section that performs position correction of the skewing adjusting roller;

a walking adjusting roller correcting section that performs position correction of the walking adjusting roller;

a control section which independently controls the position corrections of the skewing adjusting roller and the walking adjusting roller by the skewing adjusting roller correcting section and the walking adjusting roller correcting section;

a skewing detecting section which detects skewing of the conveying belt; and a walking detecting section which detects walking of the conveying belt, wherein, on the basis of a skew amount detected by the skewing detecting section and a walking amount detected by the walking detecting section, the control section controls the position corrections of the skewing adjusting roller and the walking adjusting roller by the skewing adjusting roller correcting section and the walking adjusting roller correcting section.

13. The liquid droplet ejecting device of claim 12, wherein ink droplets are ejected as the liquid droplets, and image formation is carried out.

14. The liquid droplet ejecting device of claim 12, wherein the ejecting nozzles form a plurality of ejecting nozzle rows, the ejecting nozzle rows are arranged along one direction so as to be parallel to one another, in intervals between the ejecting nozzles which are adjacent components in a direction orthogonal to a conveying direction of the recording medium, components in the direction orthogonal to a conveying direction of the recording medium are uniform, and in the intervals between the ejecting nozzles which are adjacent components in the direction orthogonal to a conveying direction of the recording medium, components in a direction parallel to the conveying direction of the recording medium are not uniform.

15. The liquid droplet ejecting device of claim 12, wherein the liquid droplet ejecting device forms a color image, and the skewing detecting section has a detecting section which detects a color registration pattern formed on one of the recording medium and the conveying belt, and the skewing detecting section detects the skew amount of the conveying belt on the basis of a detected position of the color registration pattern.

16. The liquid droplet ejecting device of claim 12, wherein the skewing detecting section has a detecting section which detects a position of an end portion of the conveying belt.

17. The liquid droplet ejecting device of claim 12, wherein the skewing detecting section has a detecting section which detects a test pattern formed on one of the recording medium and the conveying belt.

18. The liquid droplet ejecting device of claim 12, wherein the skewing detecting section has a density detecting section, and detects the skew amount on the basis of a change in density of a test pattern formed on one of the recording medium and the conveying belt.

19. The liquid droplet ejecting device of claim 12, wherein the walking detecting section has a detecting section which detects a position of an end portion of the conveying belt.

* * * * *